US005092509A

United States Patent [19]

Naito et al.

[11] Patent Number: 5,092,509

[45] Date of Patent: Mar. 3, 1992

[54] SHEET STAPLING APPARATUS

[75] Inventors: Masataka Naito; Mitsuhiro Mukasa, both of Kawasaki; Masakazu Hiroi, Yokohama, all of Japan

[73] Assignee: Canon Kabushiki Kaisha, Tokyo, Japan

[21] Appl. No.: 395,442

[22] Filed: Aug. 17, 1989

[30] Foreign Application Priority Data

| | | | |
|---|---|---|---|
| Aug. 19, 1988 | [JP] | Japan | 63-207164 |
| Aug. 19, 1988 | [JP] | Japan | 63-207165 |
| Aug. 19, 1988 | [JP] | Japan | 63-207166 |
| Aug. 19, 1988 | [JP] | Japan | 63-207168 |
| Aug. 19, 1988 | [JP] | Japan | 63-207169 |

[51] Int. Cl.[5] ..... B27F 7/19; B27F 7/36

[52] U.S. Cl. ..... 227/99; 227/100; 227/110; 227/111; 270/53

[58] Field of Search ..... 227/99, 100, 102, 110, 227/111; 270/53

[56] References Cited

U.S. PATENT DOCUMENTS

| | | | |
|---|---|---|---|
| Re. 30,031 | 6/1979 | Snellman | 271/222 |
| 3,910,568 | 10/1975 | Brown et al. | 271/221 |
| 4,313,670 | 2/1982 | Caldwell | 227/110 X |
| 4,852,867 | 8/1989 | Johdai et al. | 270/53 |
| 4,886,259 | 12/1989 | Ishikawa et al. | 270/53 |
| 4,928,941 | 5/1990 | Uto et al. | 270/53 |

FOREIGN PATENT DOCUMENTS 3107768 2/1982 Fed. Rep. of Germany .

OTHER PUBLICATIONS

Official letter European Patent Office dated Feb. 9, 1990.

*Primary Examiner*—Paul A. Bell

*Attorney, Agent, or Firm*—Fitzpatrick, Cella, Harper & Scinto

[57] ABSTRACT

A sheet stapling apparatus includes sheet accommodating contain for accommodating discharged sheets, a stapling device for stapling the sheets received by the sheet accommodating contain, a reference for confining edges of the sheets accommodated in the sheet accommodating contain to align the sheets, and aligning member for urging the sheets accommodated in the accommodating contain to the reference, and for continuing to urge the sheets to the reference when the sheets are stapled by the stapling device.

14 Claims, 23 Drawing Sheets

SHEET STAPLING APPARATUS

FIELD OF THE INVENTION AND RELATED ART

The present invention relates to a sheet stapling apparatus, and more particularly to such an apparatus usable with an image forming apparatus such as a copying machine or a printer to staple sheets discharged from the image forming apparatus and sorted by a sorter.

A sheet sorting and stapling apparatus has recently been proposed to prevent the sheets from being scattered when the sheets sorted in plural bins are taken out (Japanese Laid-Open Patent Application Publications Nos. 220053/1983 and 185355/1984). In such a sheet sorting and stapling apparatus, the sheets discharged from a copying machine, for example, are sorted into plural bins; are aligned; and are stapled for the respective sets of sheets by a stapler or the like movable into the sheet stacking position.

In this structure, since there is not provided means for positively confining the sets of sheets in the bin when the stapling means operates, the alignment of the sheets are not assured, with the result that the sheets are stapled with some of them deviated, and therefore, the stapling operation is not stable.

SUMMARY OF THE INVENTION

Accordingly, it is a principal object of the present invention to provide means for confining the sheets accommodated in each of the bins during the stapling operation by stapling means.

According to an aspect of the present invention (FIGS. 1, 2 and 3 which will be described hereinafter), there is provided an apparatus comprising a bin for accommodating sheets, a reference member for one side edge of the sheets in the bin, aligning means for urging the sheets in the bin to the reference member, stapling means for stapling the sheets in the bins, control means for controlling the aligning means so that the aligning means urges the sheets to the reference member and is maintained at the urging position during the sheet stapling operation for the sheets in the bin.

According to another aspect of the present invention, there is provided an apparatus comprising a bin for accommodating sheets, a reference member for one side edge of the sheets in the bin, aligning means for urging the sheets to the reference member, stapling means for stapling the sheets in the bin, control means for repeatedly moving the aligning means to urge the sheet to the reference member each time a sheet is received by the bin, and for moving the aligning means to and maintaining it at the urging position when the sheet in the bin is stapled.

In the first mentioned aspect of the present invention, the aligning means is moved to its urging position and is maintained at the urging position when the sheets are stapled in the bin, and therefore, during the stapling operation, the sheets are confined by the aligning means so that the sheets can be stapled without deviation.

According to the second mentioned aspect, the aligning means is repeatedly moved to the urging position each time a sheet is received by the bin, and in addition, during the stapling operation, the aligning means is moved to the urging position and is maintained thereat. Therefore, during the sheet stapling operation, the sheets are confined so that they can be stapled without deviation.

In the following, the description will be made as to a sorter, but the present invention is not limited to the sorter, but is applicable to a stapler provided in a simple sheet discharge tray.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 3:
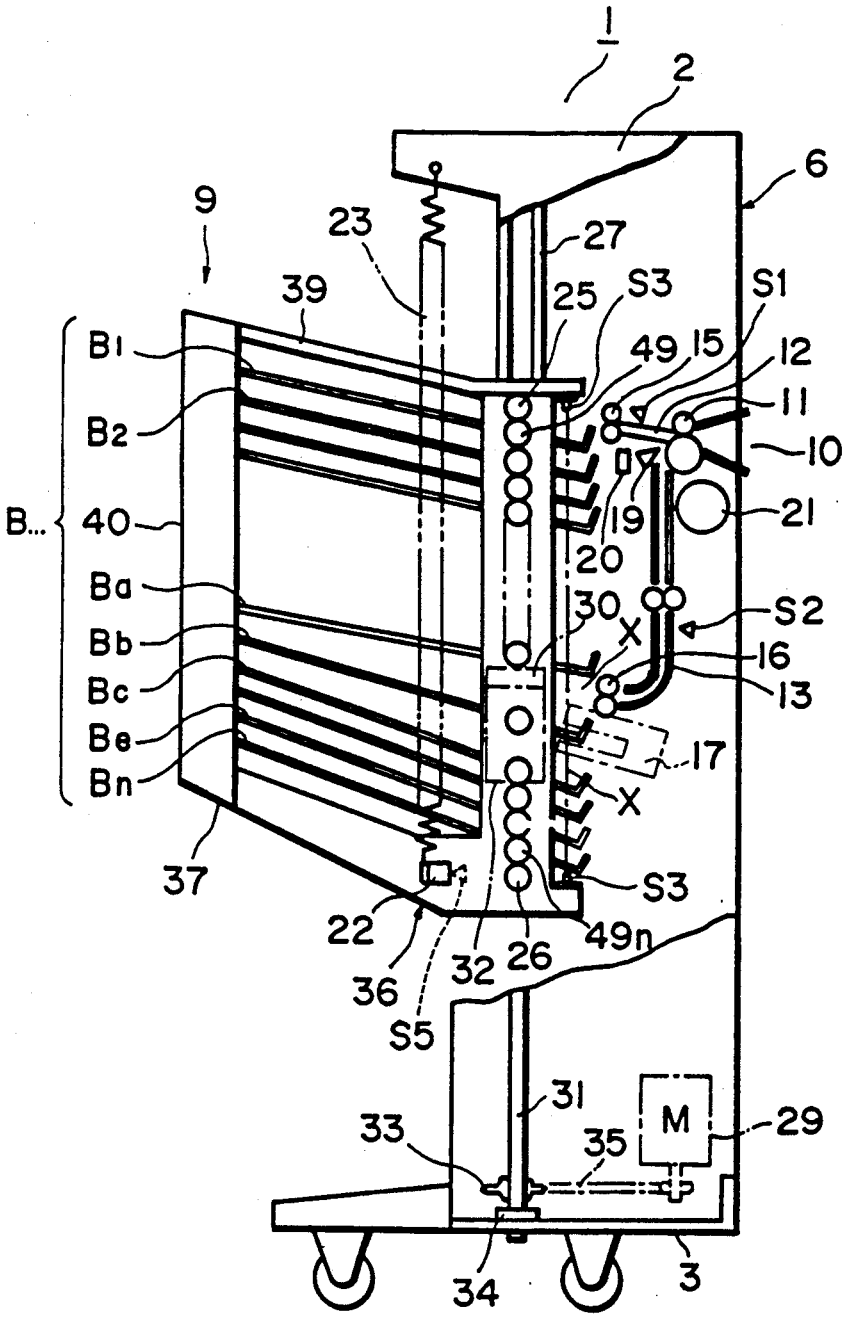
FIG. 3 is a side view of a sorter according to an embodiment of the present invention.
Figure 4:
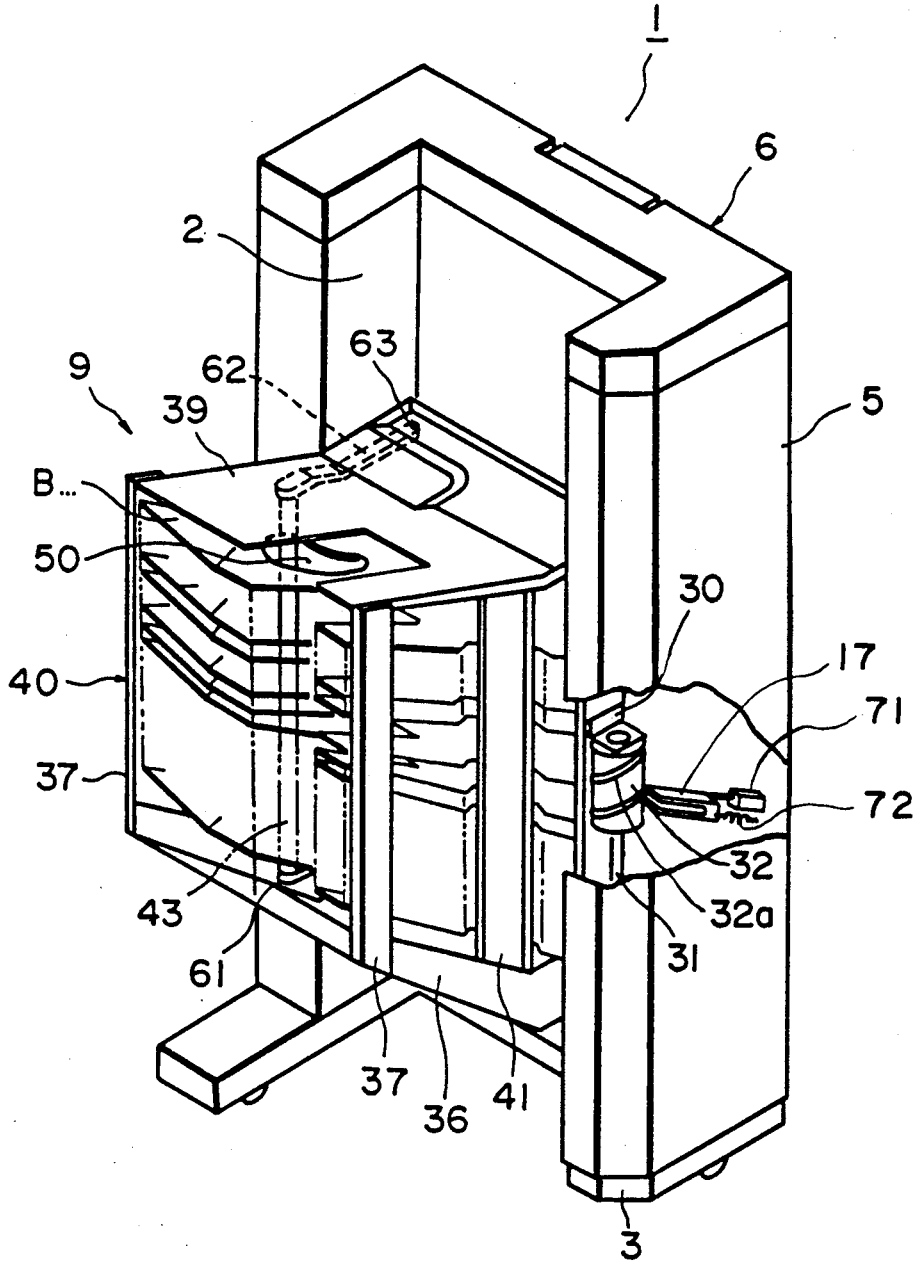
FIG. 4 is a perspective view thereof.

Referring first to FIGS. 3 and 4, there is shown a sorter 1 according to an embodiment of the present invention, which is generally comprised of a main assembly 6 including front and rear plates 2, a base 3 and a cover 5, and a vertically movable bin unit 9 having a number of bins B.

The main assembly 6 includes a pair of inlet rollers 11 adjacent a sheet inlet 10 for receiving a sheet discharged from an image forming apparatus such as a copying machine. Downstream of the inlet rollers 11, there are a non-sorting passage 12 and a sorting passage 13 branched out of the non-sorting passage 12. The non-sorting passage 12 extends generally horizontally to a non-sorting discharge outlet where a pair of non-sorting discharging rollers 15 is disposed. The sorting passage 13 extends generally downwardly to a sorting discharge outlet where a pair of sort discharging rollers 16 is disposed. Adjacent to the sort discharging rollers 16, an electric stapler 17 is disposed.

Adjacent to the inlet rollers, there are a flapper 19 for switching the sheet conveyance direction and a flapper solenoid 20 for driving the flapper 19. When the flapper solenoid 20 is actuated, the flapper 19 is shifted to direct the sheet toward the nonsorting discharge outlet 15, whereas when the flapper solenoid 20 is not energized, the sheet is directed to the sort discharging outlet 16.

Adjacent the inlet rollers, a conveying motor 21 is disposed to drive the inlet rollers 11, the nonsorting discharge rollers and the sort discharging rollers 16 when the sheet P is distributed to the bin B.

The non-sorting passage 12 is provided with a sheet sensor (non-sorting passage sensor) S1, whereas the sorting passage 13 is provided with a sheet sensor (sorting passage sensor) S2.

Downstream of the non-sorting discharge rollers 15 and the sort discharging rollers 16, the bin unit 9 is disposed. The bin unit 9 is fixed at its one side to the main assembly 6, and the other side is substantially vertically movable, wherein the weight is balanced with a spring 23 engaged with a hook 22 of the bin unit 9. The bin unit 9 is provided adjacent the fixed side with an upper guiding roller 25 at its upper position and with a lower guiding roller 25 at a lower position, the rollers 25 and 26 being rotatable. The upper and lower guiding rollers 25 and 26 are engaged with a guiding plate 27 fixed to the main assembly 6, extending substantially vertically. When the bin unit 9 is moved up or down, the rollers roll along the guiding plate 27 to guide the bin unit 9. The main assembly is provided with a bin unit driving motor 29. Adjacent the sort discharging rollers 16 of the main assembly 6, there is a cam shaft holder 30, and between the cam shaft holder 30 and a thrust bearing 34 mounted on the base 3, a lead cam shaft 31 is rotatably supported. Above the lead cam shaft 31, a lead cam 32 is disposed. A sprocket 33 is fixed to the bottom of the lead cam shaft 31. Between the sprocket 33 and the bin unit driving motor 29, a chain 35 is trained, so that the lead cam 32 is driven by the bin unit guiding motor 29 selectively in its forward or backward direction.

Figure 2:
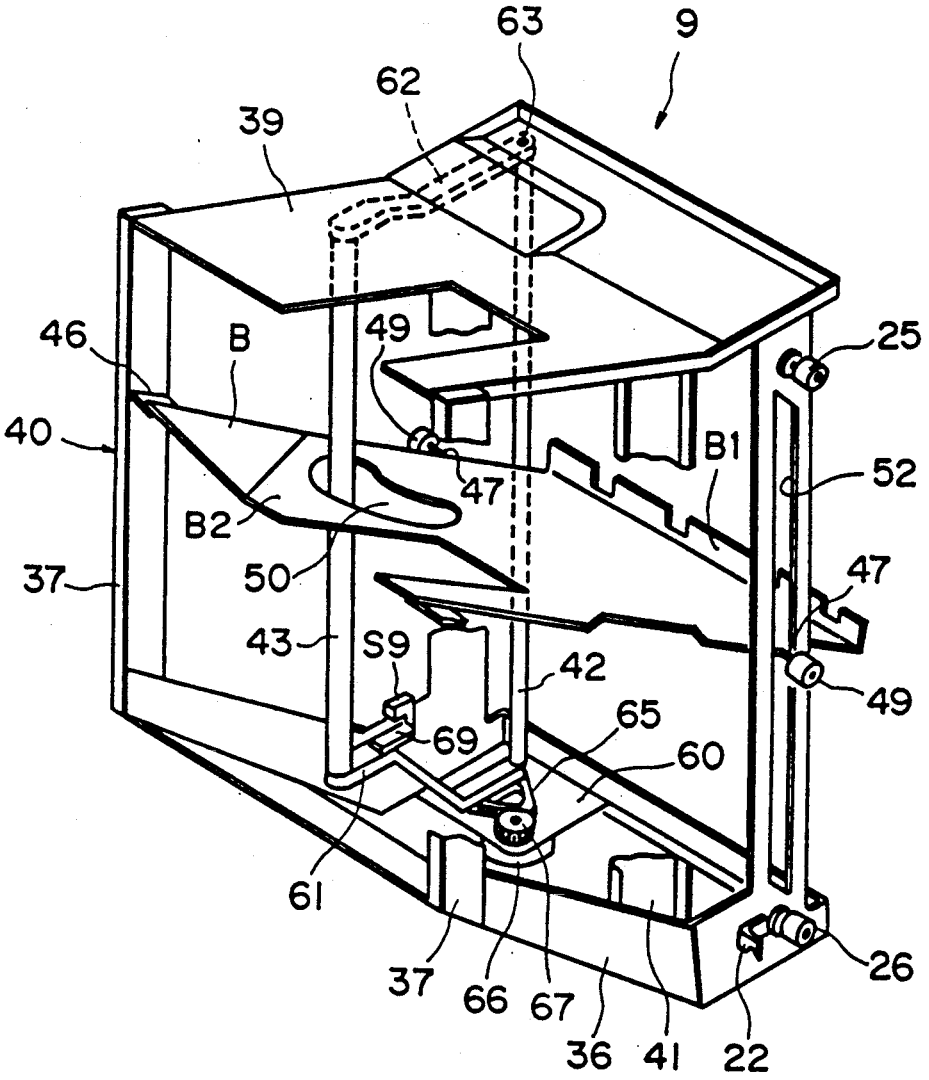
FIG. 2 is a perspective view thereof.

Referring to FIG. 2, the bin unit 9 includes a frame 36 having an inclined portion, a vertical portion and a horizontal portion, vertical frames 37,37 at front and rear sides of an end of the inclined portion of the frame 36, and a bin cover 39 supported by vertical frames 37,37, wherein these frames and the bin cover 39 constitute a bin unit main assembly 40. Adjacent the front side of the bin unit main assembly 40, a reference plate 41 for alignment of the sheets by abutment therewith are mounted. The bin unit 9 has a number of bins B and an aligning rod 43 swingable about a shaft 42.

Figure 1:
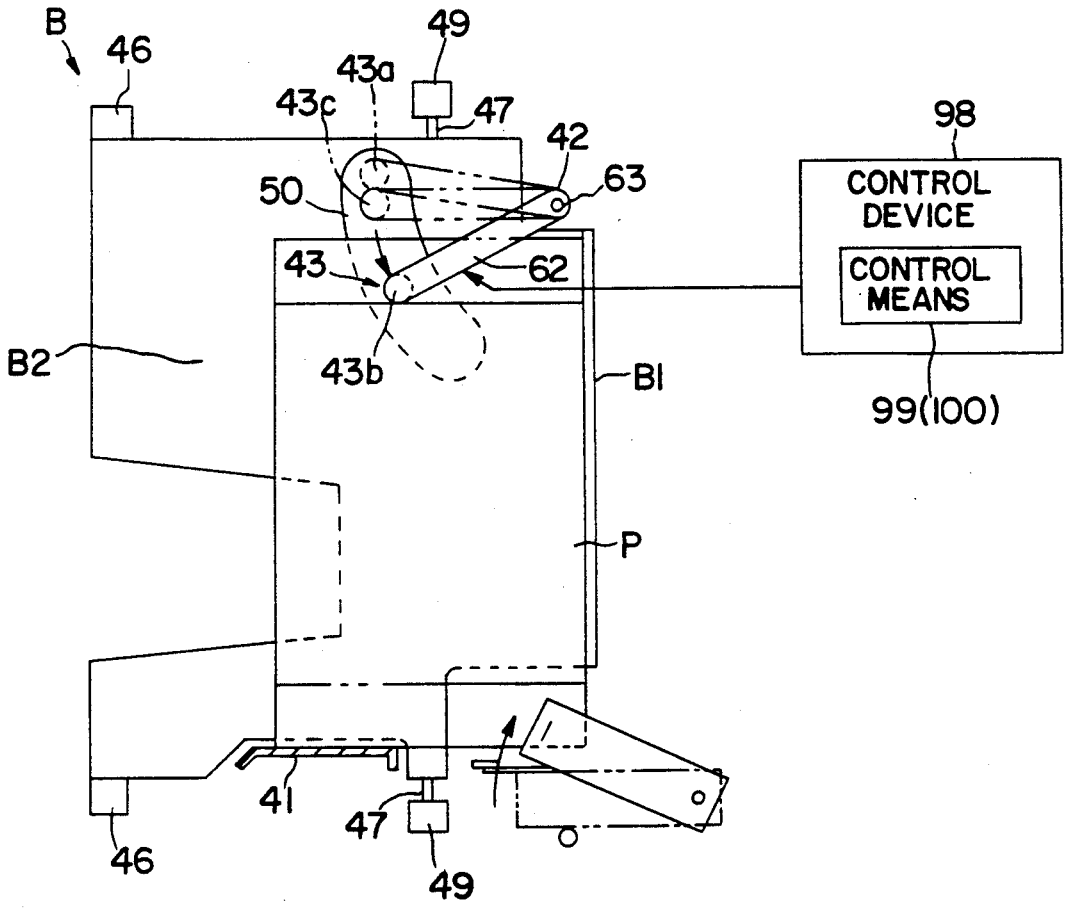
FIG. 1 is a top plan view of the structure around an aligning rod.

Referring to FIG. 1, the bin B is provided with engaging plates 46 at its front and rear sides adjacent its free end. The engaging plates 46 are engaged with supporting plates (not shown) mounted at inner sides of the vertical frames 37, by which the free end of the bin B is supported. Roller supporting pins 47 are fixed to the base side of the bin B at its front and rear sides, and the pins 47 rotatably support bin rollers 49. In the bin B, an elongated slot 50 is formed; the slot 50 is spaced from the shaft 42 by a predetermined distance, and has a length larger than the swinging distance of the alignment rod 43 and a width sufficiently larger than the diameter of the alignment rod 43. The base end portion B1 of the bin B extends substantially vertically to a sheet receiving surface B2. The bin B is inclined at a predetermined angle downwardly away from the free end relative to the main assembly 6 (FIG. 3). By the inclination, the sheet slides on the sheet accommodating surface B2 until the trailing edge of the sheets abuts the base portion B1 for alignment in the sheet movement direction.

As shown in FIGS. 2 and 3, the bin rollers 49 penetrate through an elongated slot 52 formed at the base portion of the bin unit main assembly 40 and engage the guiding plate 27 of the main assembly 6. The bin rollers **49*n* of the bottommost bin Bn are supported on the lower guiding rollers 26; and the second bottom rollers 49 of the second bottom bin B are supported on the bin rollers 49*n* of the bottommost bin Bn. In the similar manner, bin rollers 49 are supported on the bin rollers 49 of the immediately lower bin B, whereby the base side of the bin is supported on the bin unit main assembly 40**.

Figure 5:
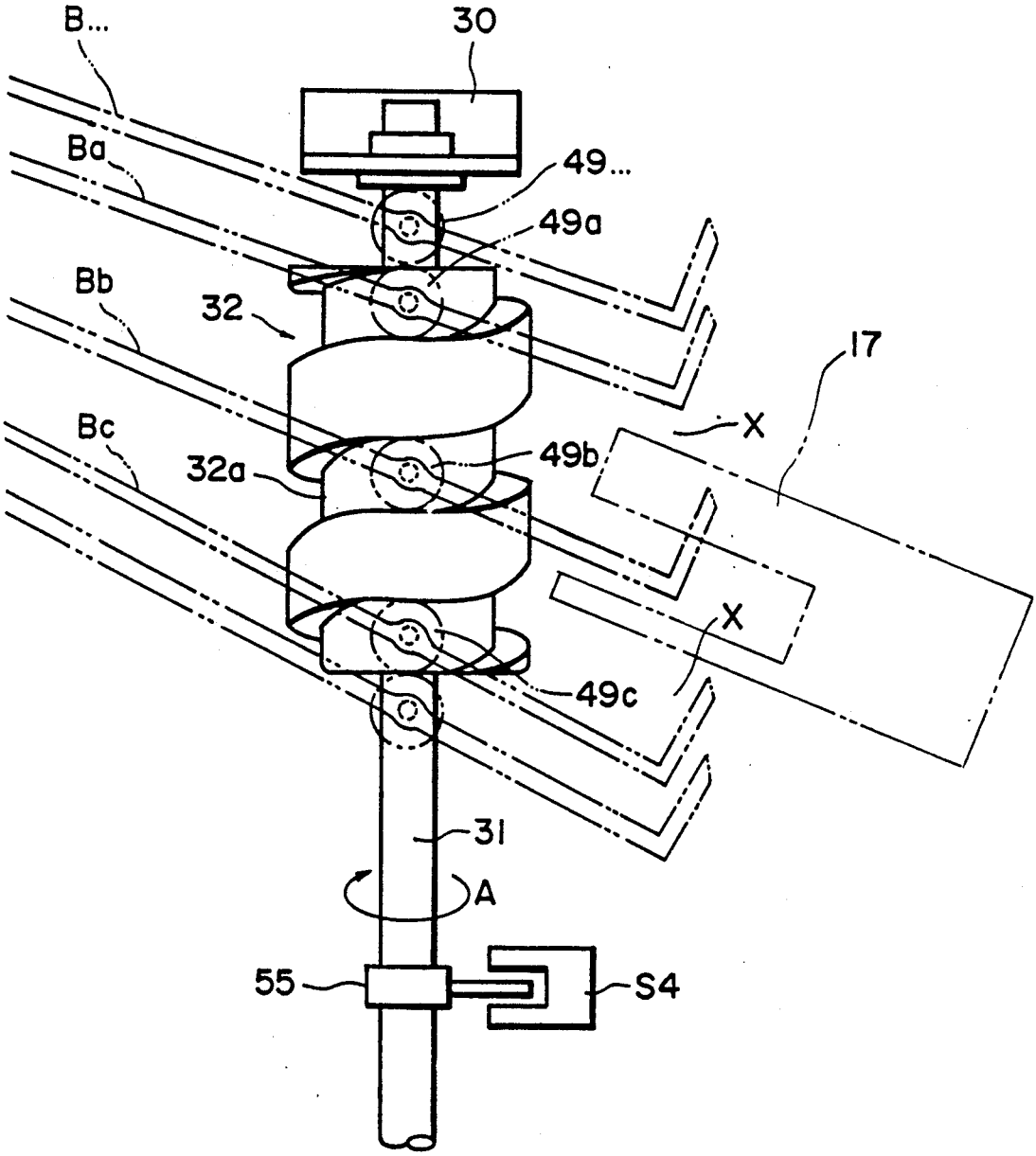
FIG. 5 is a side view of a lead cam used in the sorter.
Figure 6:
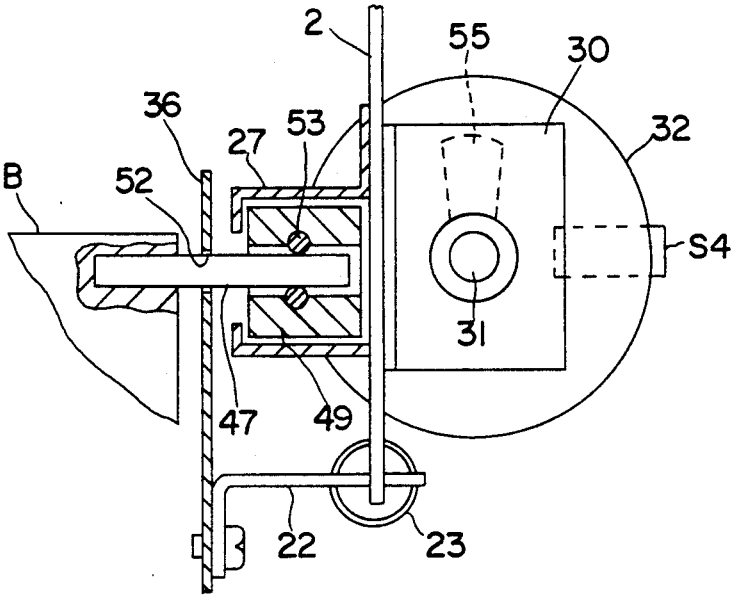
FIG. 6 is a top plan view of the lead cam.

As shown in FIGS. 5 and 6, the lead cam 32 has a helical groove **32*a* having a width slightly larger than the bin roller 49. The lead cam 32, during its rotation, receives in its cam slot 32*a* the bin roller 49 of the bin B existing at a position facing the sort discharging rollers 16. As shown in FIG. 5, for example, by one full turn of the lead cam 32 in the direction indicated by an arrow A, the bin roller 49*c*** of the bin B*c* is displaced to a longitudinally middle portion of the lead cam 32 (position of **49*b*). By a further full turn thereof, it is displaced to a position where the roller 49 goes through the lead cam 32 (the position of 49*a*). By the next one full turn of the lead cam 32, the bin roller 49*a* raises the immediately following bin roller 49, and the upper bin roller 49 raises the next upper bin roller 49, and in this manner, the topmost bin roller 49 raises the upper guiding roller 25. As a result, the bin unit 9 moves up by one stage (FIG. 3). Together with the movement of the bin roller 49, each of the bins is sequentially moved. At this time, as shown in FIG. 5, for example, at the position facing the sort discharging roller couple 16, relatively larger openings X and X are formed between the bin Bb for receiving the sheet from the sort discharging rollers 16 and the immediately upper and lower bins Ba and Bc, respectively, the opening X and X being larger than the interval between the other adjacent bins. In this manner, the rotation of the lead cam 32 moves the bin unit 9 up and down. The main assembly 9 is provided with a bin home position sensor S5 facing the hook 22 of the bin unit 9 placed at its bottommost position. The bin unit 9 moved to the bottommost position (home position) is detected by the bin home position sensor S5. The lead cam shaft 31 is provided with a flag 55. Facing to the flag 55 there is provided a lead cam sensor S4 to detect the flag 55 upon which the one full turn of the lead cam 32 is discriminated. Also, the lead cam sensor S4 detects the stop position of the lead cam 32. In FIG. 6, an O-ring 53 press-fitted in the bin roller 49** is effective to absorb the vibration produced during the upward or downward movement of the bin B.

At the upper and bottom portions of the base portion in the bin unit, there are sheet detecting sensors S3 and S3 of a transparent type (FIG. 3). When all of the sheets P are taken out of the bin unit 9, the absence of the sheet in the bin is detected by the sheet sensors S3 and S4, so that completion of one series of operations is discriminated.

As mentioned hereinbefore, the bin unit 9 is provided with an aligning rod. Referring back to FIGS. 1 and 2, the alignment of the sheet P using the aligning rod 43 will be described.

A supporting plate 60 is provided at the rear and base side of the frame 36. The supporting plate 60 is provided with a lower arm 61. The lower arm 61 is rotatably supported at its one side on an unshown lower rotational shaft projecting upwardly from the supporting plate 60. To a side of the lower arm 61, a bottom portion of the central shaft 42 is fixed coaxially with the lower rotational shaft. At the other side, the bottom portion of the aligning rod 43 is fixed. The top end of the aligning rod 43 and the top end of the central shaft 42 are fixed to an upper arm 62. Thus, the aligning rod 43 and the central shaft 42 are connected by the upper and lower arms 62 and 61. The central shaft 42 is rotatably supported on the upper rotational shaft 63 projecting downwardly from the bin cover 39, and the aligning rod 43 is swingable about a pivot provided on the central shaft 42. To the lower arm 61, a sector gear 65 is fixed having a rotational center coaxial with the rotational center of the lower arm 61. Below the supporting plate 60, a driving motor 66 for driving the alignment rod is disposed. An output gear 67 of the driving gear 66 is meshed with the sector gear 65, so that the alignment rod 43 is swung by the rotation of the alignment rod driving motor 66.

When the alignment rod 43 is to align the sheet P, it is moved to a lateral shifting position 43*b* determined in accordance with the size of the sheet P, from its home position 43*a*. By this, the alignment rod 43 abuts the lateral edge of the sheet P to cooperate with the aligning reference plate 41 to align the sheet P. Thereafter, it moves back to the stand-by position 43 to be prepared for the alignment operation for the next sheet. The movement distance of the aligning rod 43 is determined in accordance with the number of pulses applied to the driving motor 66 which is a stepping motor.

A light blocking plate 69 is fixed to the lower arm 61, so that it moves together with the lower arm 61 to actuate or deactuate the aligning rod home position sensor S9 fixed to the frame 39.

Figure 7:
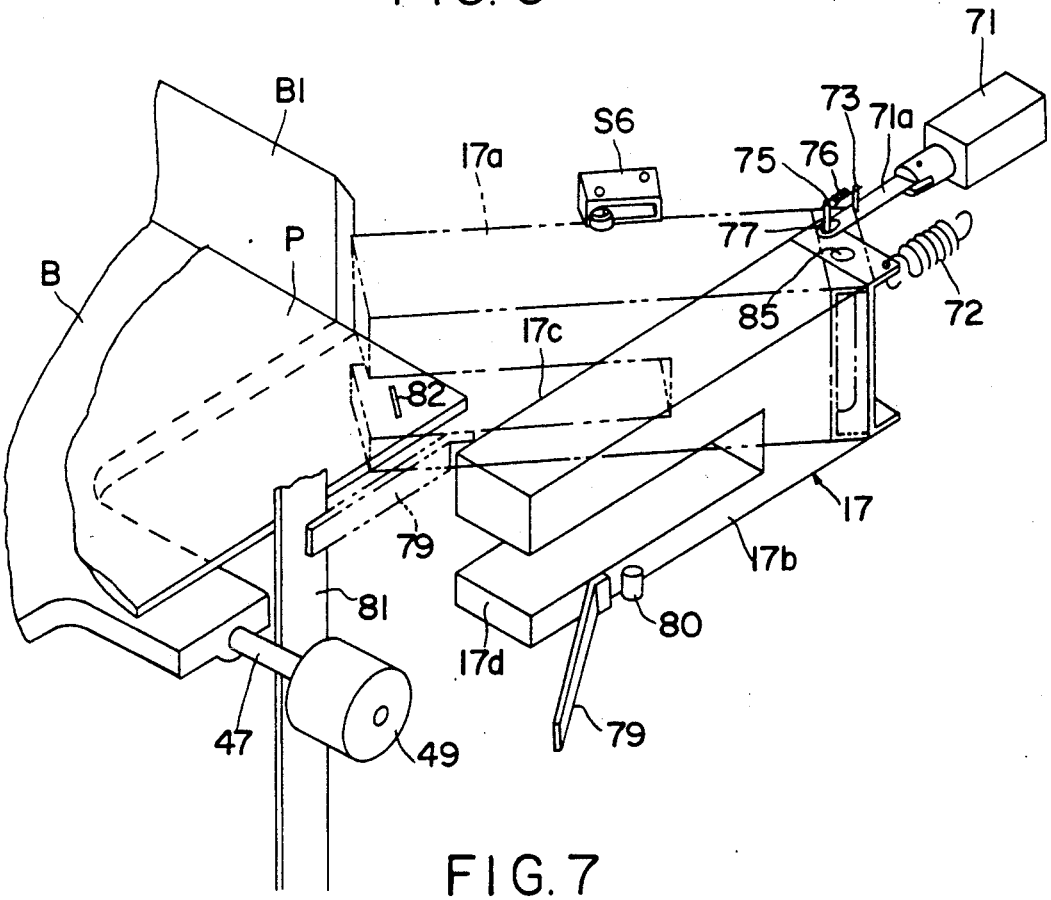
FIG. 7 is a perspective view of an electric stapler used in the sorter.

As mentioned hereinbefore, the electric stapler 17 is disposed adjacent to the sort discharging rollers 16. As shown in FIG. 7, the electric stapler 17 is equipped with a solenoid 71 and a stapler spring 72. The solenoid 71 has a link 71*a* to which the link pin 73 is fixed. Between the link pin 73 and a stapler pin 76 of the electric stapler 17, a solenoid spring 76 is stretched. A link 71*a* is engaged with a stapler pin 75 through an elongated slot 77 formed adjacent an end thereof. The electric stapler 17 is provided with a stapling position stopper 79 fixed thereto. Normally, the electric stapler 17 is abutted to the stopper 80 by the spring force of the stapler spring 72 so that it is at its retracted position 17*b* (solid line position in the Figure) outside the sheet passage. When the sheets P in the bin B are to be stapled, the solenoid 71 is operated to move the stapler to its stapling position 17*a* (chain line position in the Figure) to be positioned by abutment to the reference plate 81 by the stapling position stopper 79. Then, the sheets P accommodated in the bin B faced to the sort discharging rollers 16 are stapled with a stapler 82.

As shown in FIG. 7, a stapling position sensor S6 serves to detect the electric stapler 17 positioned at its stapling position 17*a* to produce a detection signal.

When a stapling mode is selected, the solenoid 71 is actuated in response to a staple starting signal, and then, the electric stapler 17 swings about a pivot 85 by the operation of the solenoid 71 to the stapling position 17*a*, where the stapling position stopper 79 is abutted to the reference plate 81.

At this time, a head 17*c* of the electric stapler 17, as shown in FIG. 5 is displaced to the stapling position 17*a* through an upper opening X formed between the bin Bb accommodating the sheets to be stapled and the immediately upper bin Ba. On the other hand, the anvil 17*d* is moved to its stapling position 17*a* through the lower opening.

When the electric stapler 17 is positioned at its stapling position 17*a*, the stapling position sensor S6 is actuated, in response to which the electric stapler 17 is energized so that the sheets P are stapled with staple 82.

After the sheets are stapled, the solenoid 71 is deenergized, by which the electric stapler 17 is returned by the stapler spring 72 until it is abutted to the stopper 80. Thus, the stapling operation for one bin is completed.

Figure 8:
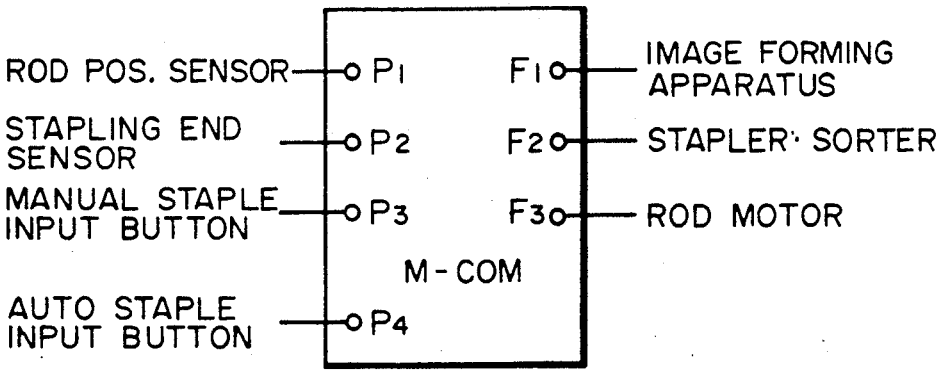
FIG. 8 shows a control system.

Referring to FIG. 8, a control device 98 for controlling the operation of the sorter 8 includes as a major component a known microcomputer containing ROM (read only memory) and RAM (random access memory) or the like. To the microcomputer, various elements such as the sheet detecting sensor S3 for detecting the sheet in the bin are connected so that signals from that those elements are transmitted to the microcomputer. It sends output signals through a driver to various means.

The control device 98 is provided with a control means 99 containing a program for confining the sheets P in the bin B when they are stapled. When the sheets P in the bin B are to be stapled, the control means 99 moves the aligning rod 43 to the lateral aligning position 43*b* to confine the sheets P between the aligning rod 43 and the alignment reference plate 41 to prevent the sheets P from being disturbed in the bin B. Further, the control means 99 controls the aligning rod 43 to maintain it at the lateral aligning position 43*b*.

Figure 9:
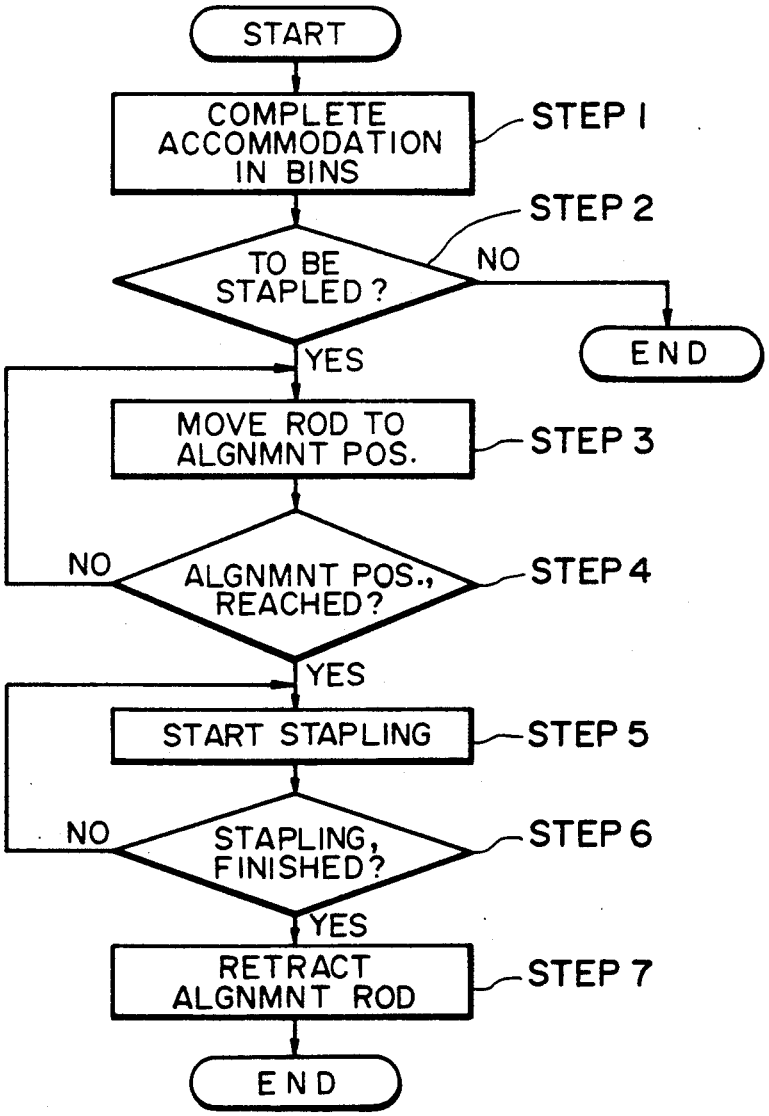
FIG. 9 is a flow chart showing an operation of the sorter.

Referring to FIG. 9, an operation of the apparatus of this embodiment will be described. When the sheets P are sequentially sorted and aligned in the bins B, and they are received by the bins B (step 1), discrimination is made as whether or not the stapling mode is selected. When the stapling mode is selected (step 2), the aligning rod 43 is moved to the lateral aligning position 43*b* (step 3). When the aligning rod 43 reaches the lateral aligning position 43, the sheets P in the bin are confined by the aligning rod 43 (step 4). Then, the stapling operation by the electric stapler 17 is started (step S5), and the sheets are stapled without disturbance of the sheets. Upon completion of the sheet stapling operation (step 6), the aligning rod 43 is returned to its home position 43*a* (step 7). By this, it is assured that all the sheets in the bin are stapled with the alignment maintained.

A second embodiment of the present invention will be described wherein the control system of the control means 99 is partly modified.

In this embodiment, the control means 100 operates the aligning rod to align the sheet P each time the sheet is received by the bin B, and in addition, when the sheets P are stapled, they are confined. More particularly, the control means 100 repeats the movement of the aligning rod 43 to the lateral aligning position 43*b* for the respective receipts of the sheets P in the bins, in addition, when the sheets P are stapled in the bin B, the aligning rod 43 is moved to the lateral aligning position 43*b* to confine the sheets P between the aligning rod 43 and the alignment reference plate 41, and the aligning rod 43 is maintained at the aligning position 43*b*.

Figure 10:
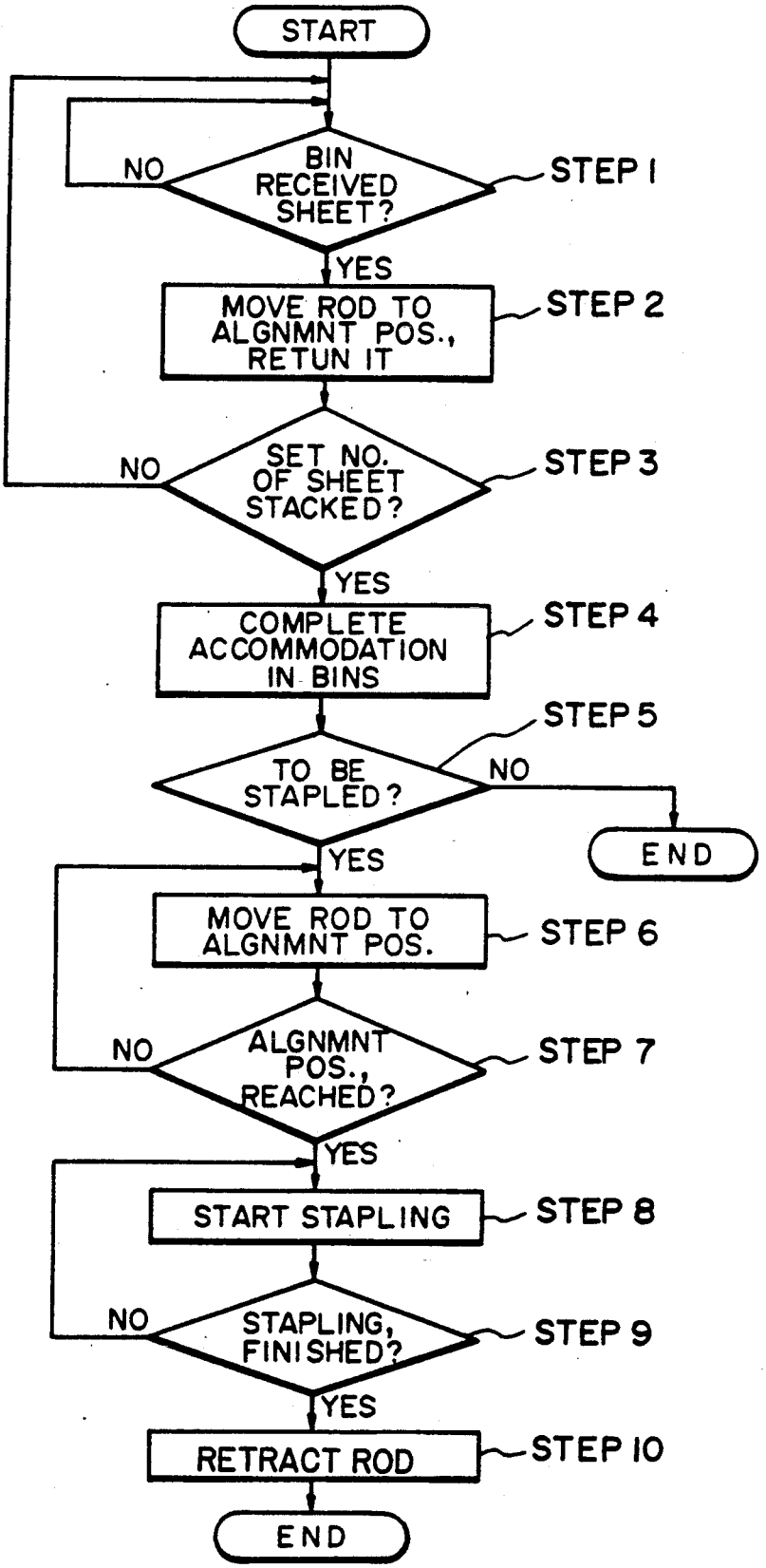
FIG. 10 is a flow chart showing the operation of the sorter in a different matter.

Referring to FIG. 10, the operation in this embodiment will be described. When the sheet P is discharged to the bin B (step 1), the aligning rod 43 is moved to the lateral aligning position 43*b* to align the sheet P by abutting the sheet P to the alignment reference plate 41, and then is returned to the standby position 43*c* (step 2). The aligning operation of the alignment rod 43 is repeated for the discharge of the sheet P, sequentially. When a preset number of sheets P is received by the bin B (step 3), the accommodation of the sheets P in the bins B are completed (step 4). Similarly to the foregoing embodiment, description is made as to the whether or not the stapling mode is selected. If so (step 5), the aligning rod 43 is moved to the lateral aligning position 43*b* (step 6). When the aligning rod 43 reaches the lateral aligning position 43*b*, the sheets P in the bin B are confined by the aligning rod 43 (step 7), the electric stapler 17 starts its stapling operation (step 8), and the sheets P in the bin B are stapled. Upon completion of the sheet stapling operation (step 9), the aligning rod 43 is returned to its home position 43*a* (step 10). By this, the sheets P in the bins are aligned for the respective bins, and they are assuredly stapled with the alignment maintained.

Figure 11:
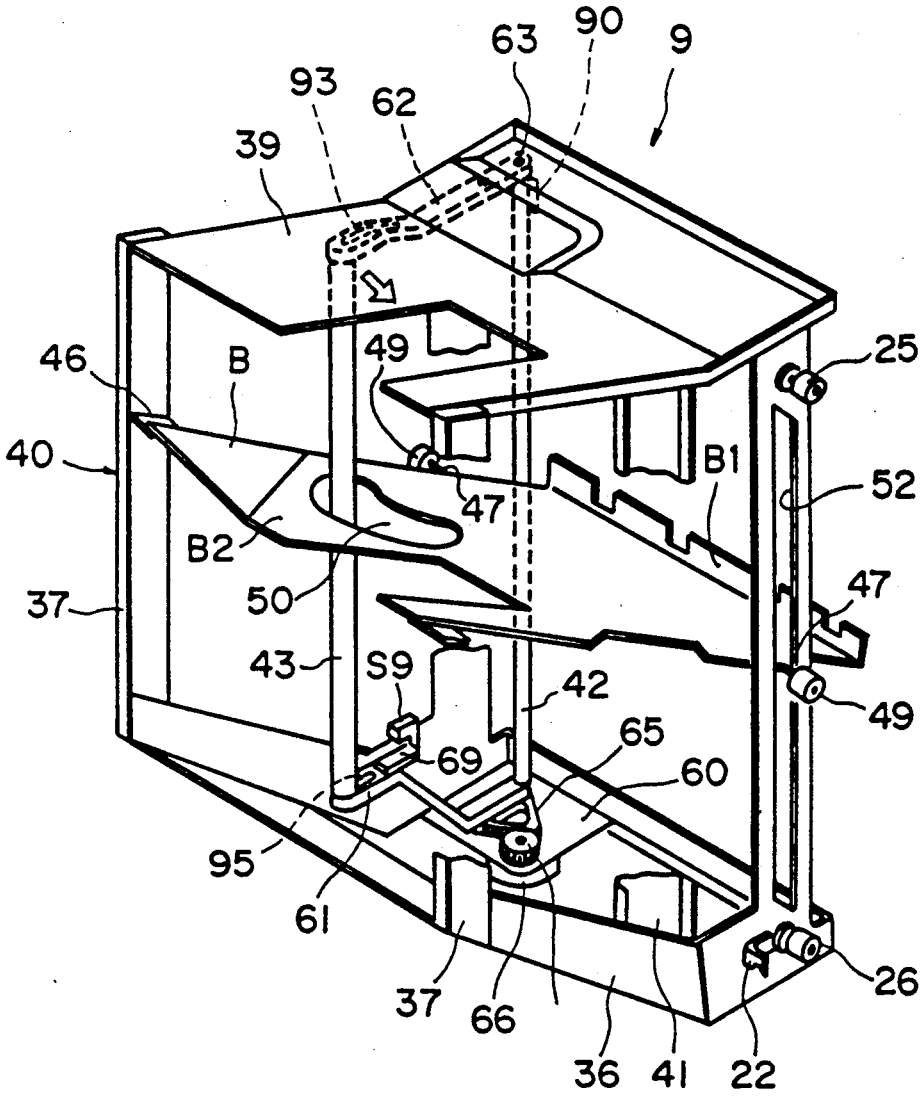
FIG. 11 is a perspective view of a bin unit.
Figure 12A:
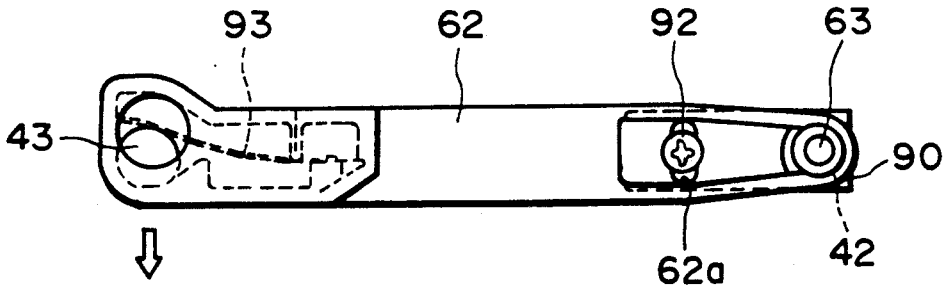
FIG. 12A is a top plan view of an upper arm of the bin unit.
Figure 12B:
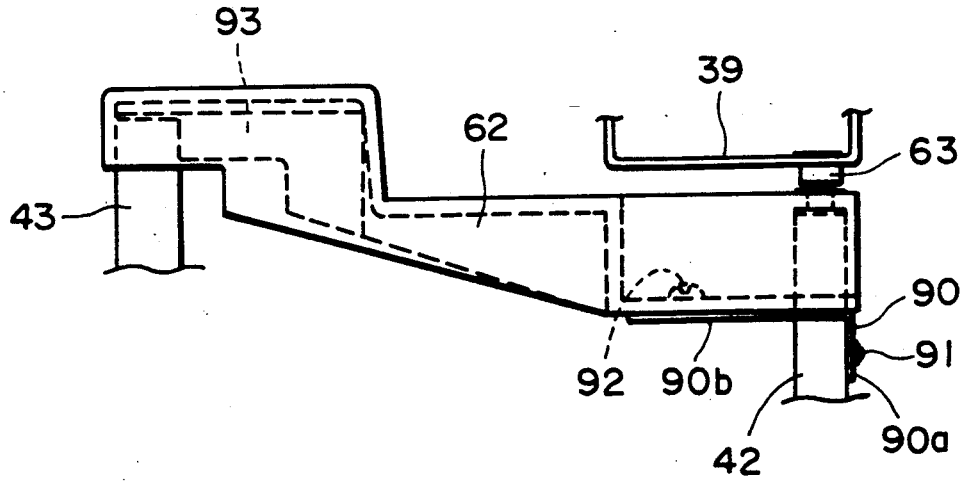
FIG. 12B is a side view of the upper arm.

Referring to FIGS. 11 and 12, a modified alignment rod will be described. In FIG. 11, the same reference numerals as in FIG. 2 are assigned to the elements having the corresponding functions. The bin unit 9 is provided with an aligning rod 43. As shown in FIG. 11, a lower arm 61 is provided at a side thereof with a central shaft 42 having a bottom fixed coaxially to a lower rotating shaft. The central shaft 42 is rotatably supported on a upper rotational shaft 63 projecting downwardly from the bin cover 39. At the other side of the lower arm 61, the alignment rod 43 is fixed to the lower arm 61. The upper portions of the aligning rod 43 and the central shaft 42 are connected by the upper arm 62, and the aligning rod 43 is supported on the central shaft 42 for movement about the shaft 42, through the upper and lower arms 62 and 61.

At the junction between the central shaft 42 and the upper arm 62, an upper L shaped arm fixing plate 90 is provided, wherein the upper arm 62 is rotatably supported on the central shaft 42. The upper arm fixing plate 90, as shown in FIG. 12, has an end 90*a* fixed to the central shaft 42 by screws or the like, and the other end 90*b* fixed to the upper arm 62 by screws 92 or the like at a position having been adjusted for the parallelism. The upper arm 62 is provided with a slot 62 for the adjustment of the parallelism.

At the jointing portion between the aligning rod 43 and the upper arm 62 and the lower arm 61, as shown in FIG. 11, there are leaf springs 93 and 95. The leaf spring 93 of the upper arm 62, as shown in FIG. 12, is built in the upper arm 62 to normally urge the aligning rod 43 in the direction indicated by an arrow. The same applies to the leaf spring 95 of the lower arm 61. By the provision of the upper arm fixing plate 90, the parallelism of the aligning rod 43 to the alignment reference plate 41 can be easily adjusted, so that the sheets P in all of the bins B are uniformly urged to the alignment reference point 41.

Since the leaf springs 63 and 65 are provided in the upper arm 62 and the lower arm 61, respectively, the alignment performance can be maintained even if the sheets are contracted or expanded under different ambient conditions. For example, by the setting wherein the distance between the aligning rod 43 and the alignment reference plate 41 is shorter than a predetermined size of the sheet, it can meet contraction of the sheet, whereas the expansion of the sheet can be met by the leaf springs 93 and 95, through which only weak force is applied to the sheets.

Operation of the apparatus according to this embodiment will be described. The sheets P accommodated in each of the bins are acted on by the aligning rod 43 moved to the lateral aligning position 43*b* each time the sheet is received by the bin B, so that the sheets are aligned along the alignment reference plate 41. At this time, if the urging force of the aligning rod 43 to the sheet P is not uniform among the upper bins B and the lower bins B, the fixing position of the upper arm 62 on the upper arm fixing plate 90 is adjusted by unthreading the screws 92 and shifting the arm 62, by which the parallelism of the aligning rod 43 relative to the alignment reference plate 41 is adjusted. Thereafter, the arm 62 is fixed by the screws 92. By doing so, the sheets accommodated in the upper bins B and the lower bins B are uniformly urged by the action of the alignment rod 43, and is aligned uniformly.

At this time, even if the sizes of the sheets P are more or less non-uniform, the leaf springs 93 and 94 are effective to accommodate the slight differences in the size to properly align the sheets by the aligning rod 43.

In this embodiment, the leaf springs 93 and 95 are disposed at the junction portions between the 62 the alignment rod 43 and between the lower arm 61 and the alignment rod 43. The leaf springs 93 and 95 may be replaced with other elastic members such as sponges or the like.

In this embodiment, the upper arm fixing plate 90 is provided in the follower side of the central shaft 42, but it may be provided in the lower driving side.

The alignment reference plate 41 may be formed at the end of each of the bins.

As described, according to this embodiment, the sheets in the plural bins are uniformly urged by the aligning member, by the use of the adjusting means for adjusting the parallelism of the aligning member relative to the alignment reference. It is possible that the parallelism of the aligning member relative to the alignment member is adjusted, so that the sheets can be uniformly aligned over all of the bins.

If the aligning member is supported through the elastic member as described above, the uniform alignment can be obtained even if the sheets are expanded or contracted in accordance with the ambient conditions.

A further embodiment will be described wherein the problem arising when the bin does not have any sheet at the time of starting the sheet stapling operation by the stapling means.

Figure 13:
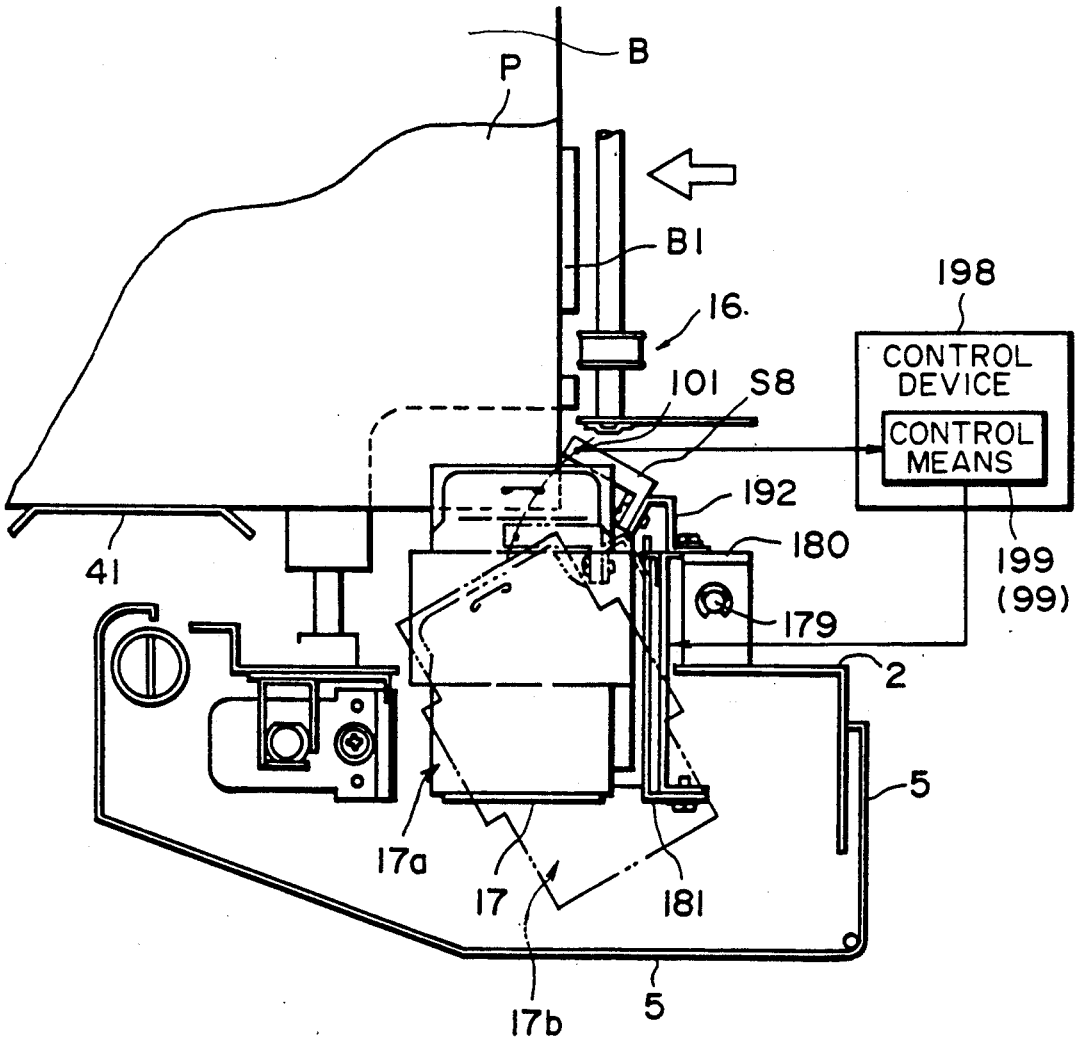
FIG. 13 is a view taken along I—I of FIG. 17 to illustrate movement of a stapler in an apparatus according to another embodiment of the present invention.
Figure 17:
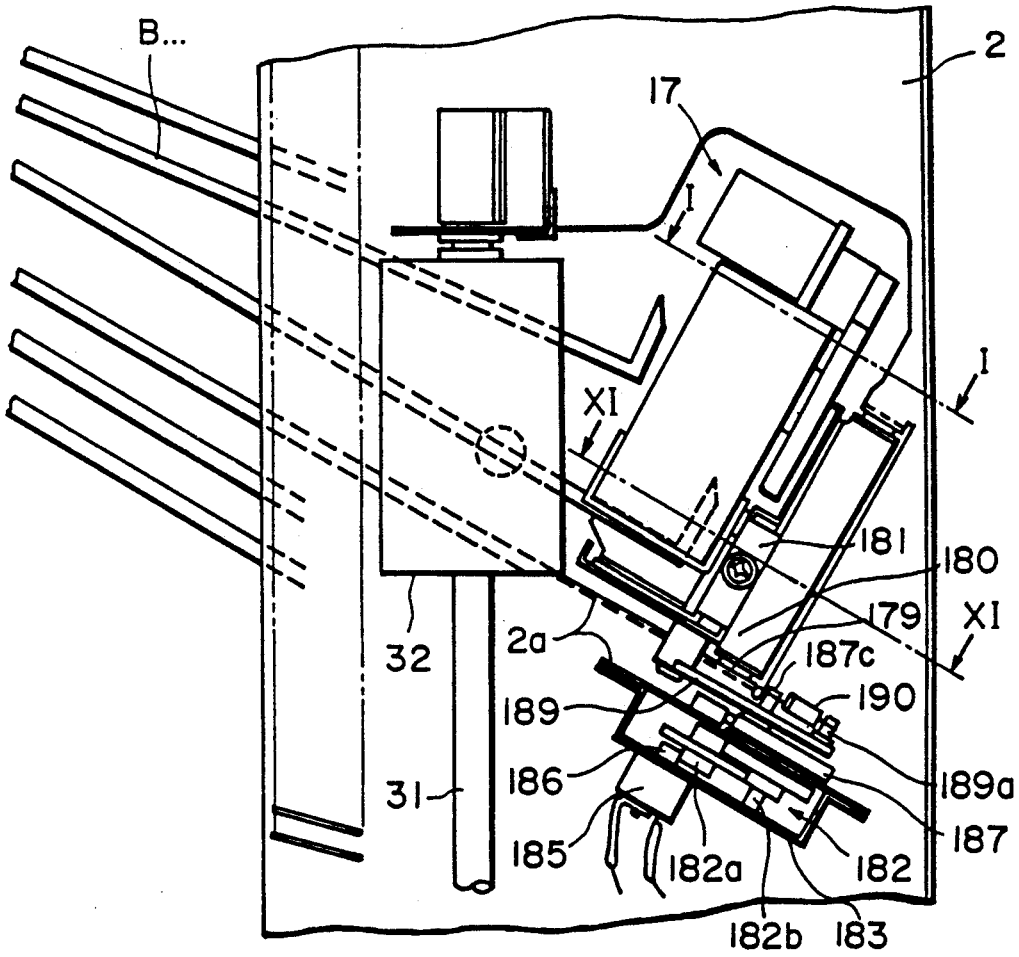
FIG. 17 is a side view of the stapler illustrating movement of the stapler.

Reference will be made to FIGS. 13 and 17 to describe this embodiment. In these Figures, the same reference numerals as in FIGS. 1 and 7 are assigned to the elements having the corresponding functions. The stapler 17 is provided with a stapler motor 171 and a gear 172 fixed to an output shaft of a stapler motor 171. The gear 172 is meshed with a gear 173. To the gear 173, a link 175 having an end fixed to a main assembly is connected. The link 175 supports a head 176 for the stapling operation at its articulation 175*a*. Below the head 176, an anvil 177 is disposed. Adjacent the head 176 and the anvil 177, upper and lower guides 174 and 174 are disposed. The upper and lower guides 174 and 174 provide an opening for smoothly receiving a curled sheet. To the gear 173, a one rotation cam 178 is mounted, and a stapler cam sensor S10 is disposed opposed to the cam 178, so that the stapling operation by the stapler 17 is detected by the stapler cam sensor S10 for each stapling operation.

The stapler 17 is provided with a staple cartridge 184, which accommodates a number of staples connected together. The staple cartridge 184 can be supplied from behind the stapler 17. Upon exchange of the cartridge, the used cartridge is retracted in the direction indicated by an arrow E.

Figure 14:
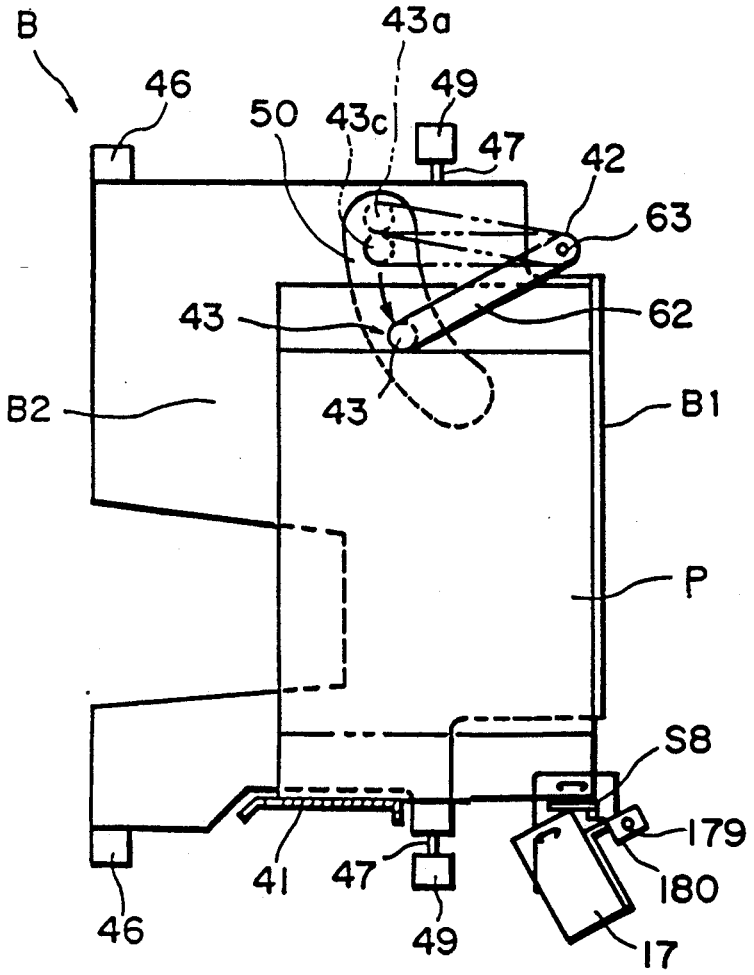
FIG. 14 is a top plan view of a bin.
Figure 15:
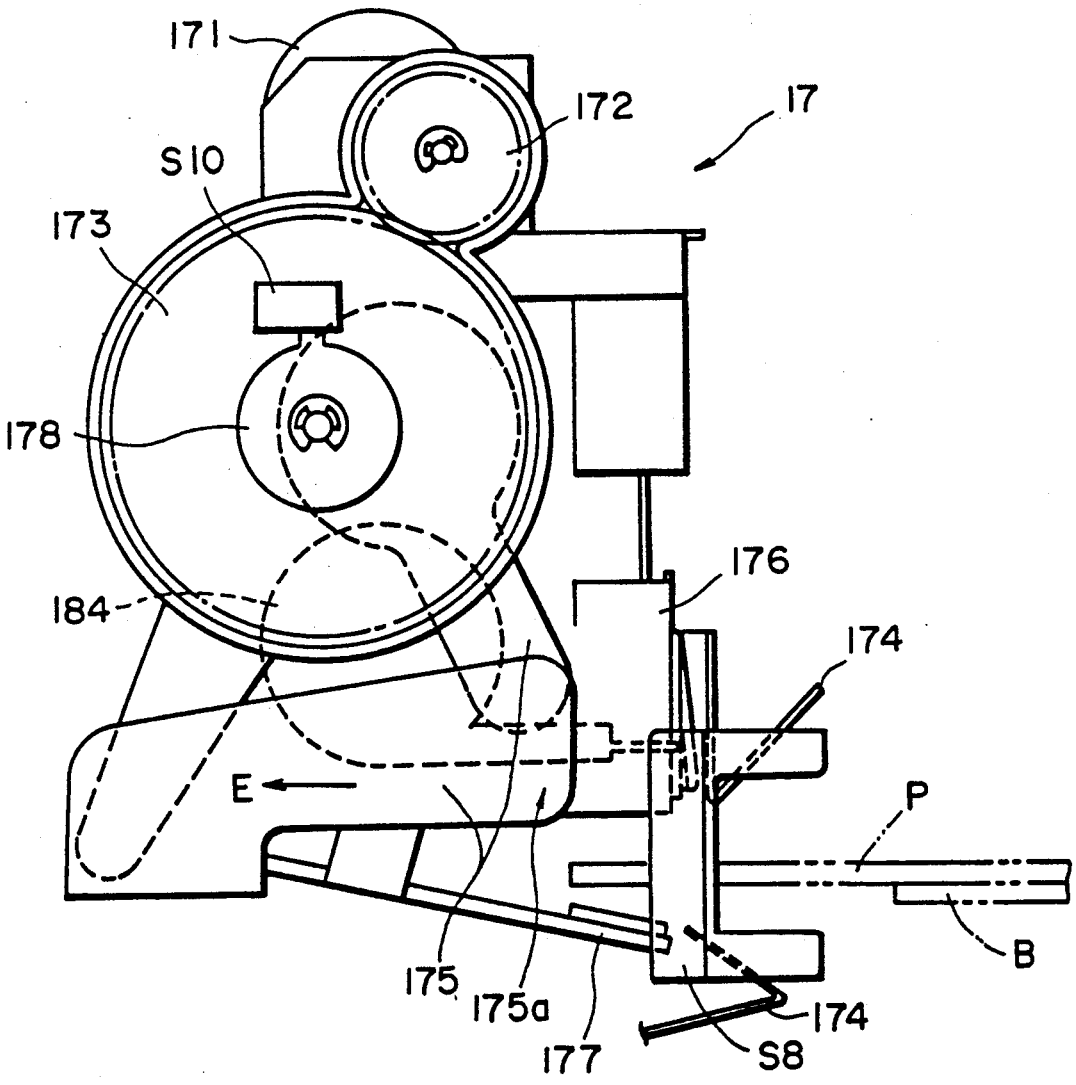
FIG. 15 is as side view of a stapler.
Figure 16:
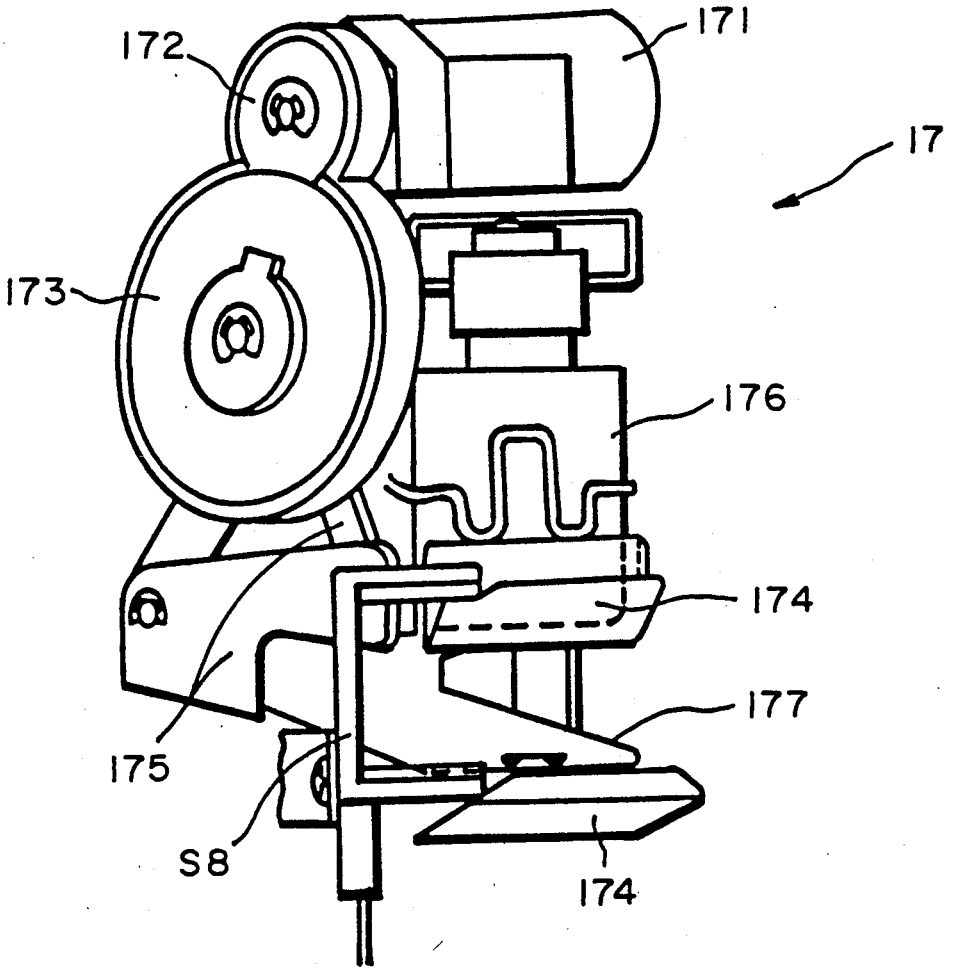
FIG. 16 is a perspective view of the stapler.
Figure 18:
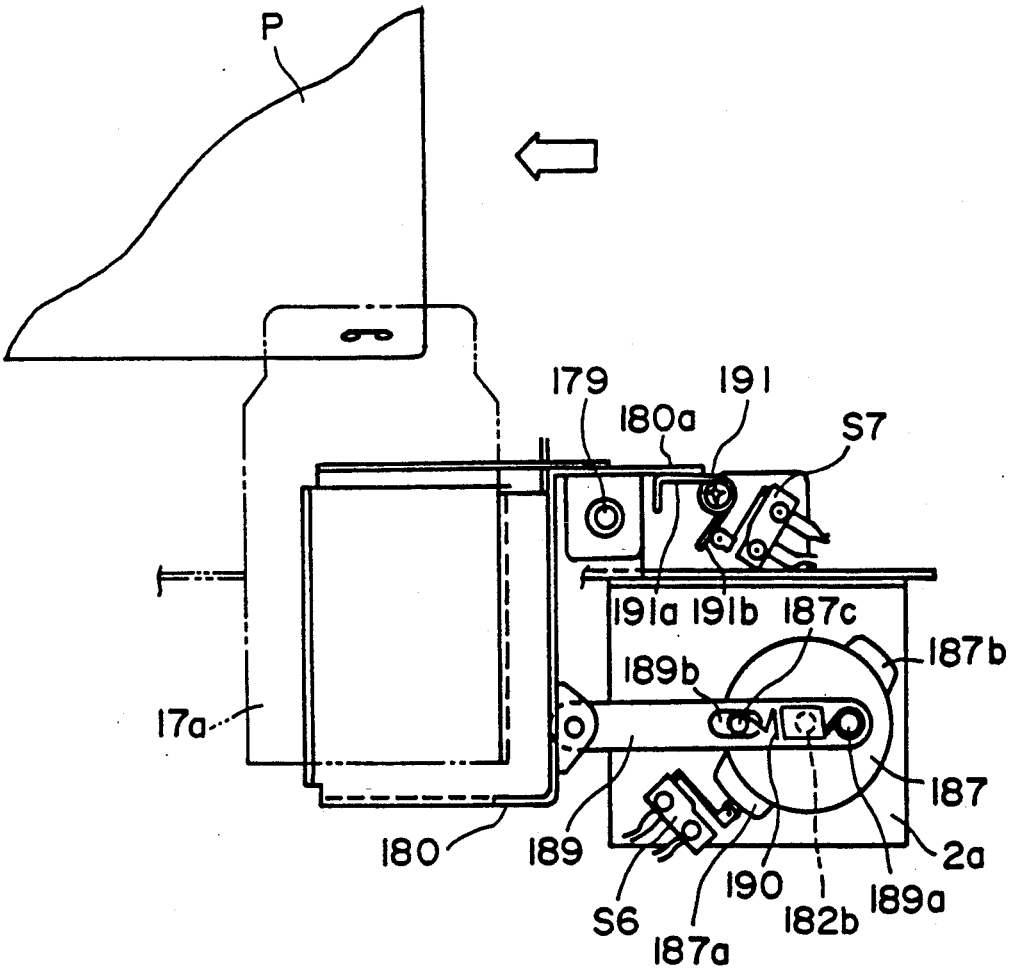
FIG. 18 is a sectional view taken along XI—XI of FIG. 17.

As shown in FIGS. 13, 14 and 18, the stapler 17 is provided with a stapler driver 188 to move the stapler 17 between its stapling position 17*a* and is retracted position 17*b* (FIG. 13). A shaft 179 is fixed to the frame 2*a* of the main assembly, and a swingable base 180 has a staple base 181 fixed thereto, and the stapler 17 is mounted to the staple base 181. The frame 2*a* has a gear box 183 containing a reduction gear train 182, and a stapler swinging motor 185 is provided on the gear box 183. A gear 186 fixed to the output shaft of the stapler swinging motor 185 is meshed with an input gear 182*a* of the reduction gear train 182. A link disk 187 is fixed to the output gear 182*b* of the the reduction gear train 182. The link disk 187 is provided on its outer peripheral with cam portions 187*a* and 187*b* diametrically opposed. The cam portions 187*a* and 187*b* actuate and deactuate a stapler positioning sensor S6 disposed on the frame 2*a* to actuate the stapler swinging motor 185. Adjacent the outer periphery of the link disk 187, a shaft 187*c* is provided. To the swinging base 180, a link arm 189 is connected, extending substantially horizontally. To the link arm 189, a shaft 189*a* is mounted, and an elongated slot 189*b* is formed. In the elongated slot 189*b*, the shaft 187*c* is engaged. Between the shaft 187*c* and the shaft 189*a*, a spring 189 is stretched. Adjacent the shaft 179, a sensor actuating arm 191 made of resin material or the like is rotatably supported. An end 191*a* of the sensor actuating arm 191 is contacted to an end 180*a* of the swinging base 180, and the other end 191*b* is contacted to the stapler operating position sensor S7. When the stapler 17 staples the sheets P by actuating of the stapler driver 188, it moves to the stapling position 17*a* in the bin moving region. After the stapling operation, it is moved back to the retracted position 17*b* permitting movement of the bin, and it is kept at the retracted position 17*b*.

A stapler sheet sensor S8 is mounted to the swinging base 180 through a mounting base 192. The sensor S8 is in the form of a transparent type sensor having a channel-like cross section containing therein a sensing element at its sensing position 101 at its end.

When the stapler 17 moves to the stapling position 17*a* from the retracted position 17*b*, the stapler sheet sensor S8 moves together with the stapler 17 to pass the sheets P on the bin B, bridging over the end portions of the sheets P to detect the sheets.

Figure 19A:
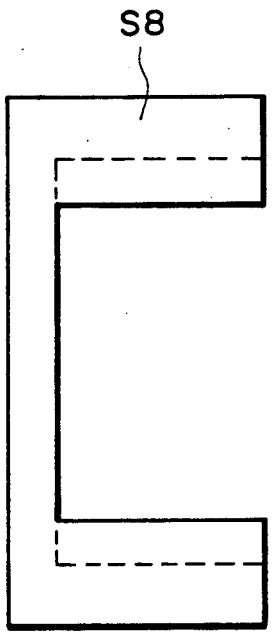
FIGS. 19A and 19B show a stapler sensor.
Figure 19B:
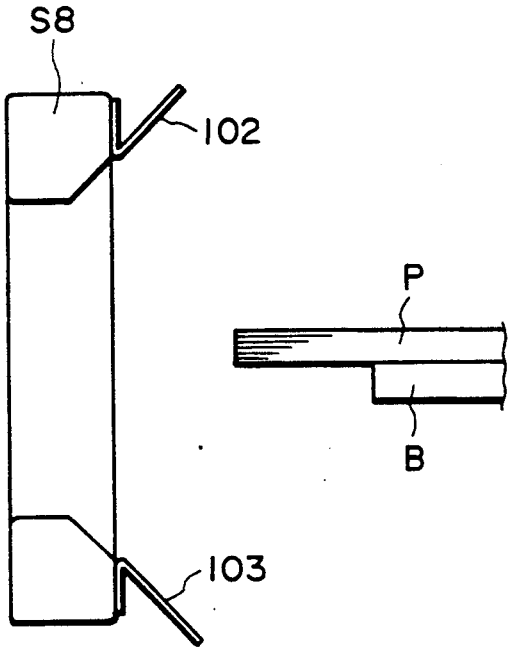
Figure 20:
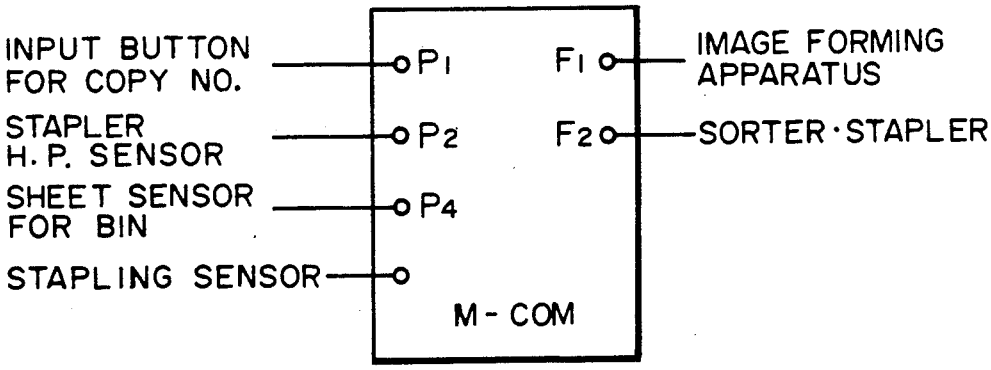
FIG. 20 is a block diagram of a control system.

As shown in FIGS. 19A and 19B, the stapler sheet sensor S8 is provided with an upper sheet guide 102 and a lower sheet guide 103, so that even if the sheet P is curled on the bin B, the stapler sheet sensor S8 is movable without disturbing the alignment of the sheet P in the bin B.

As shown in FIG. 13, when the stapler 17 moves from the retracted position 17*b* to the stapling position 17*a*, the sensing element 101 of the stapler sheet sensor S8 has crossed the sheet P, but it may be stopped adjacent the sheet P. This is possible using electric control and properly disposing the sensor S8.

In this embodiment, the transparent type sensor is used as the preferable sensor, but a reflection type sensor is usable. In addition, a lead switch of an actuator type is usable if the sheets P on the bin B are securely confined by a confining means.

A control device 198 includes control means 199, by which the stapling operation is prohibited unless there is no sheet on the bin B to be acted on by the stapler 17 upon the sheet stapling operation; and the sheet stapling operation is effected for the next bin B. More particularly, upon the sheet stapling operation, the control means 199 prohibits the sheet stapling operation if a sheet P is detected on the bin by the stapling sheet sensor S8; and the sheet stapling operation is stepped to the next bin. By being so, the staple is prevented from being wastefully dispensed into the apparatus and from being jammed.

Figure 21:
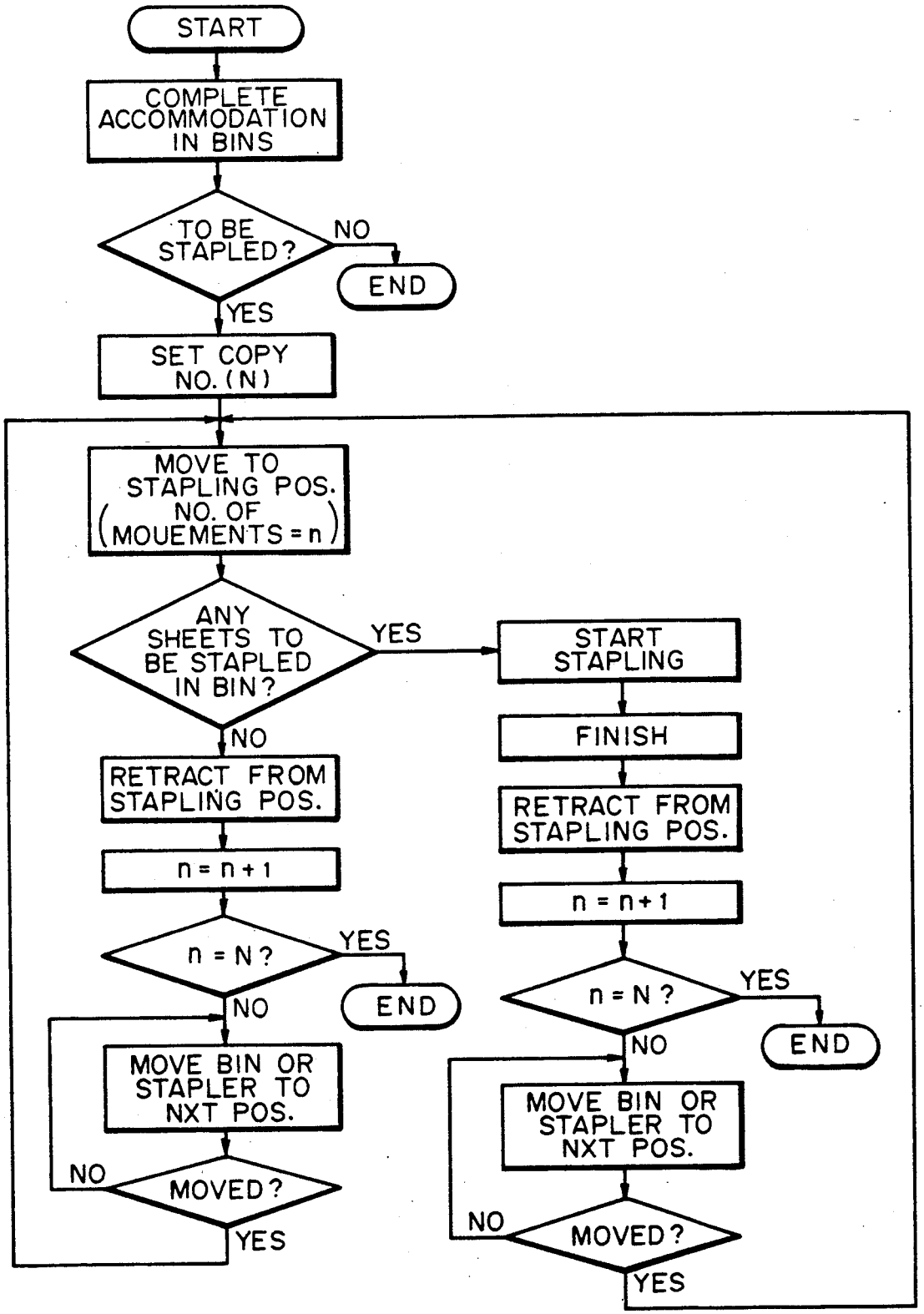
FIG. 21 is a flow chart illustrating the operation of the apparatus.

Referring to FIG. 21, the operation of the apparatus according to this embodiment will be described. When the sorting mode is selected, the sheet P discharged from the image forming apparatus such as a copying machine is sequentially dispensed into the plural bins B. The sheets P received by the bins slide on the inclined bins B to be abutted to the base end portions B1. In addition, each time the sheet P is received by the bin B, the alignment rod 43 is moved to its lateral alignment position 43*b* from its stand-by position 43*c* to urge the lateral edge of the sheet to align it for each of the bins B.

When all the sheet P are received by the bins, and the stapling mode is selected, a stapling instruction signal is produced from the image forming apparatus, in response to which the stapler driver 188 displaces the stapler 17 from its retracted position 17*b* to the stapling position 17*a*. At this time, the stapler sheet sensor S8 movable together with the stapler 17' detects whether or not the corresponding bin B contains any sheet P. Only if so, the stapler 17 is actuated for the stapling action to staple the sheet P in the bin B, and then the stapler 17 is retracted from its stapling position 17*a* to its retracted position 7*b*. When the stapler 17 reaches the retracted position 17*b*, the event is detected by the stapler positioning sensor S6 and the stapler operating position sensor S7. In response to the detections, the bin B is moved, and the same stapling operations are repeated N times to sequentially staple the sets of sheets.

It is possible that a set of the sheets P has been taken out of any bin B by the operator. During the sequential stapling operations for the bins, the stapler 19 is moved to the stapling position 17*a* for such a bin deprived of the sheets P. At this time, the stapler sheet sensor S8 movable together with the stapler 17, does not detect the presence of the sheet P. Then, the stapling operation of the stapler 17 is prohibited. The stapler 17 is moved back to the retracted position 17*b* without performing the stapling operation, and is shifted to the next bin B. In this embodiment, the stapling operation is started after all the sheets are accommodated in the bins and after the copy completion signal is produced. However, it is possible that, the stapling operation is started as soon as the final sheet is discharged on any of the bins.

Figure 22A:
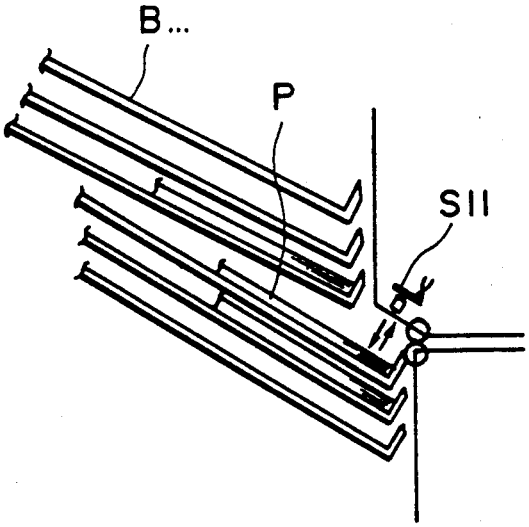
FIGS. 22A and 22B are side views of bins according to a further embodiment of the present invention.
Figure 22B:
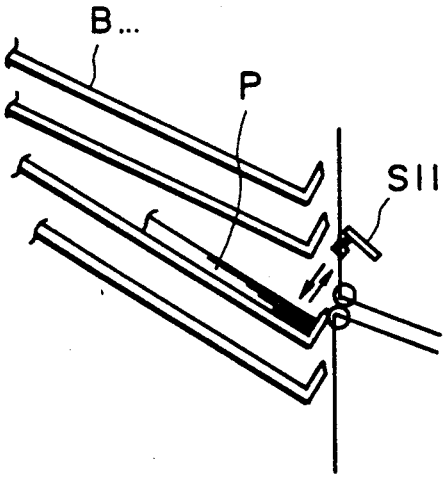
Figure 23:
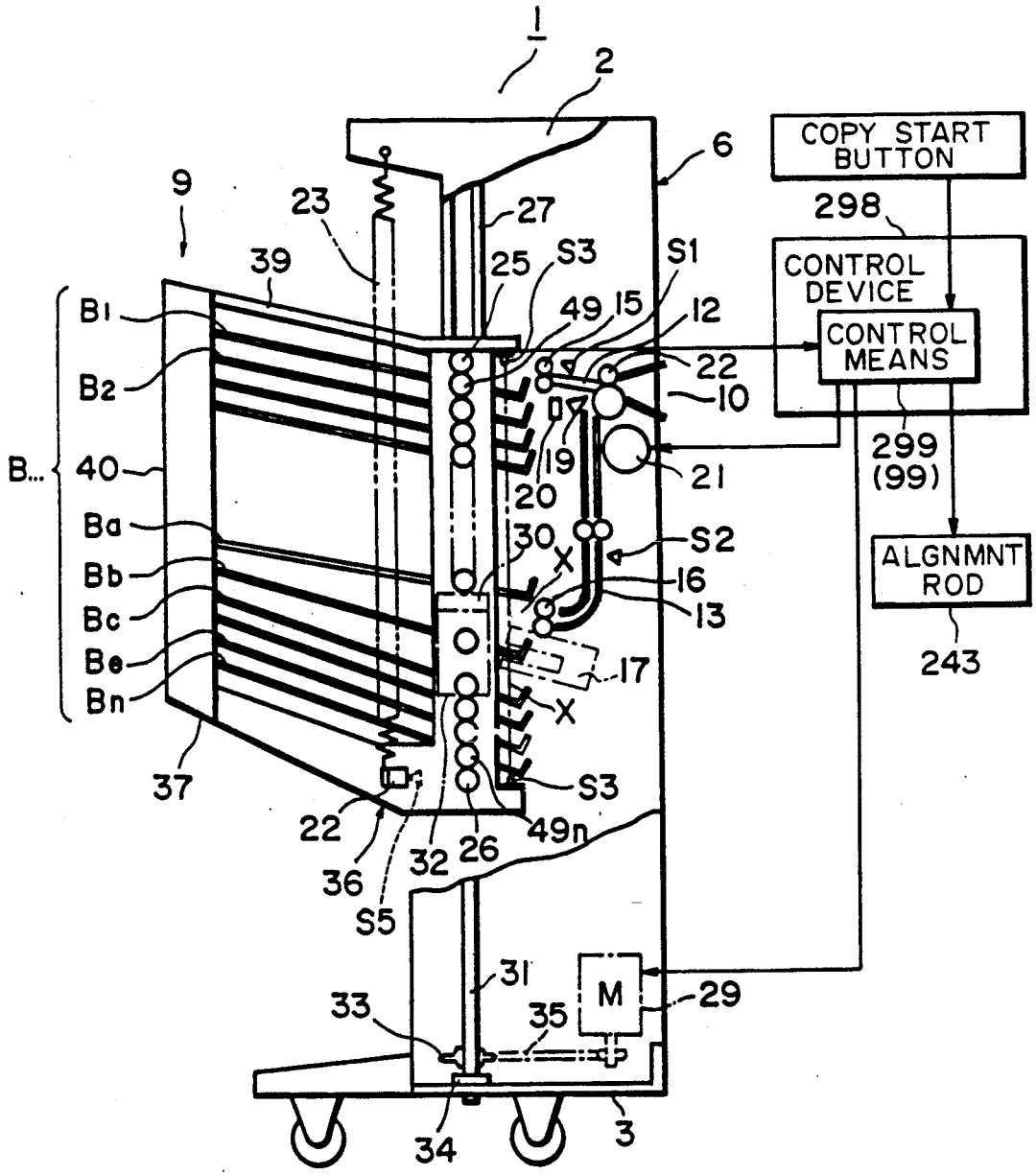
FIG. 23 is a side view of a sorter according to a further embodiment of the present invention.
Figure 24:
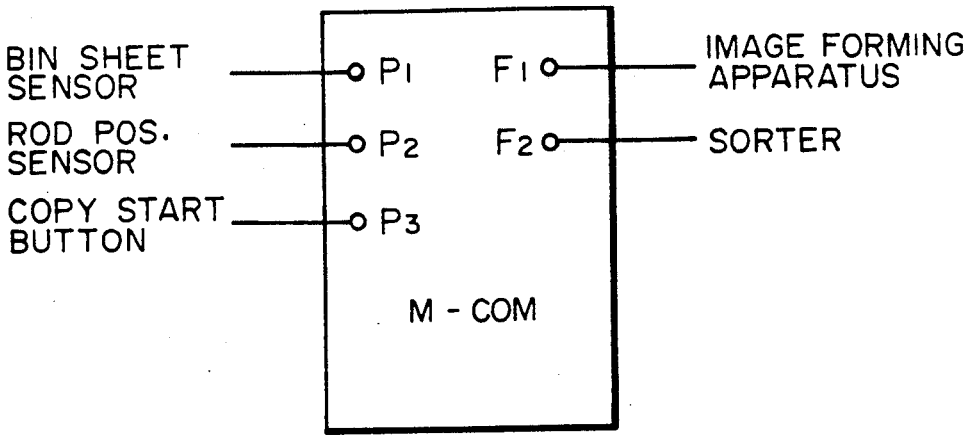
FIG. 24 shows a control system.

In this embodiment, the transparent type sensor is movable together with the stapler. However, if the bin B is slidable in the sheet discharge direction, as shown in FIG. 22A, a reflection type sensor S11 can be fixedly disposed as shown in this Figure. By doing so, the presence or absence of the sheets 0 a bin can be detected. Further, as shown in FIG. 22B, if the bin B is not movable, a reflection type sensor S11 is usable to detect the sheets at the edge portion of each of the bins. In this case, the sensor S11 may be fixed, too.

In this embodiment, the transparent type sensor is movable together with the stapler, but this is not limiting. For example, the transparent type sensor may be mounted on a unit movable separately from the stapler.

The transparent type sensor may be provided for each of the upper and lower units of the stapler. Upon the sheet stapling operation, when the sheet is positioned between the upper unit and the lower unit, the sheet is detected.

As described in the foregoing, according to this embodiment of the present invention, there is provided an apparatus comprising sheet detecting means for detecting the presence or absence of a sheet on the bin which is going to be acted on by the stapling means upon start of the stapling operation, and control means responsive to the sheet detecting means to prohibit the sheet stapling operation when the sheet is not detected by the sheet detecting means. By this, the sheet stapling operation by the stapling means can be prevented when the bin does not contain any sheet. Thus, the staple is prevented from being dispensed into the apparatus or being jammed.

A further embodiment will be described wherein the problems arising when a sheet or sheets remaining on a bin or bins. In this embodiment, the control device 298 includes a programmed control means 299 by which when a sheet P remains in a bin B, and a copy button is depressed to instruct the start, the aligning rod is moved back to and retained at its home position 43*a*, and then, dispensing of the sheet P is allowed. More particularly, when a sheet P remains on a bin B so that the bin sheet detecting sensor S3 detects the presence of the sheet, and when the copy button of the image forming operation is depressed to instruct the start, the aligning rod 43 is first moved back to its home position 43*a* so as not to interfere with the dispensed sheet P, and the aligning rod is fixed to the position 43*a*, and only then, the discharge of the sheet P to the bin B is permitted.

Figure 25:
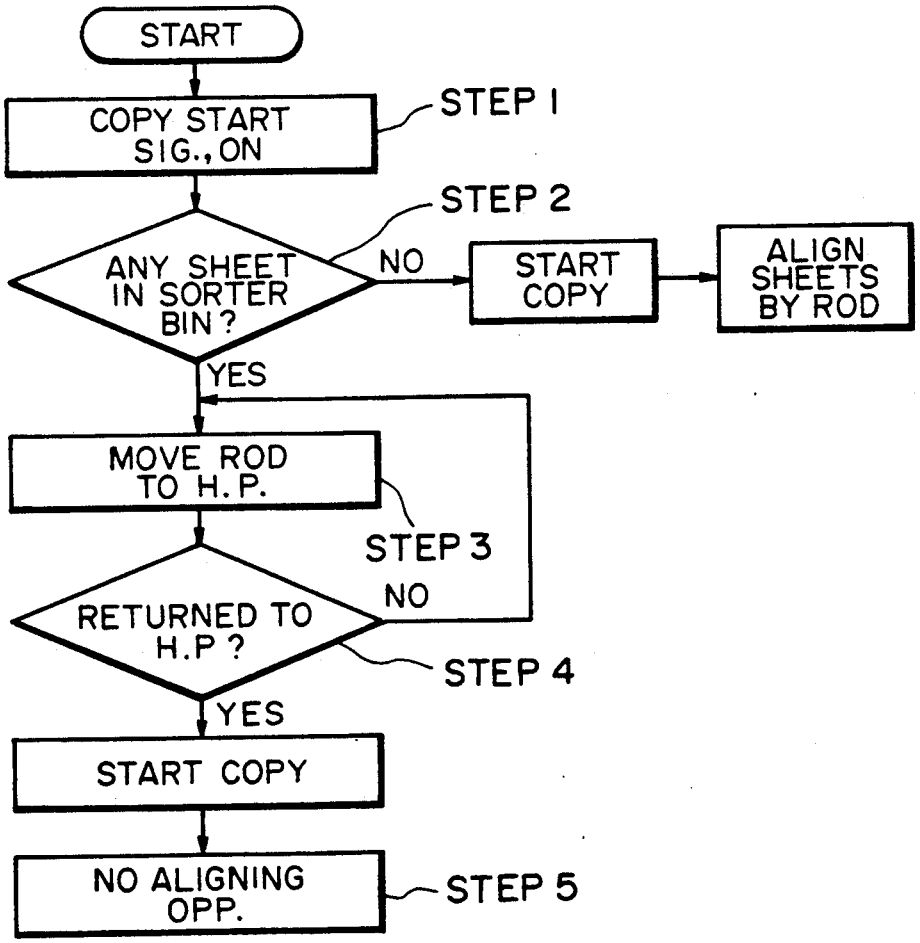
FIG. 25 is a flow chart illustrating an operation of the apparatus.

Referring to FIG. 25, the operation of the apparatus according to this embodiment will be described upon production of the copy start signal (step 1), the bin sheet detecting sensor S3 detects presence or absence of the sheet in the bins B. If the presence of the sheet is detected (step 2), the aligning rod 43 is moved back to home position 43*a*, and is retained at the position (step 4). Even if the sheet P is received by the bin, the aligning rod does not perform its aligning operation to the sheet received by the bin (step 5). Then, the conveying motor 21, and the bin unit driving motor 29 or the like are permitted to drive so as to permit the dispense of the sheets P into the bin B. By this, the sheets P can be received by the bins without interference with the aligning rod 43 irrespective of the size of the sheets P. Therefore, the bins B can receive the sheet P even if various sizes of the sheets are dispensed.

It is added here that the sheet stapling mode is prohibited when different sizes of sheets are discharged.

In this embodiment, the aligning rod is moved back to and retained at the home position, when a sheet remains in a bin, but the aligning rod may be moved to a different position if it is away from the sheets.

It is also possible that the sheet aligning operation is permitted when the size of the sheets discharged is the same as or larger than the size of the sheet remaining on the bin, but the aligning operation is prohibited by retracting the alignment rod 43 if the size of the sheet is smaller than that of the sheet remaining on the bin. This is accomplished by adding a step for detecting the size of the sheet after the step 2 so that the sequence goes to the step for aligning the sheets by the aligning rod when the size of the sheets is the same or larger than sheets remaining on the bin.

As described in the foregoing, according to this embodiment of the present invention, there is provided an apparatus comprising control means for moving the aligning means to a predetermined position away from the sheet and retaining its at the predetermined position when a remaining sheet is detected upon start of the operation, and for allowing discharging of the sheet to the bin. By this, even if the sheet remains on the bin, various sizes of the sheets can be discharged without interference with the aligning means. Thus, the inconveniences arising when various sizes of sheets are discharged can be eliminated.

A further embodiment will be described wherein the problems with a manually operable stapler are solved.

Figure 26:
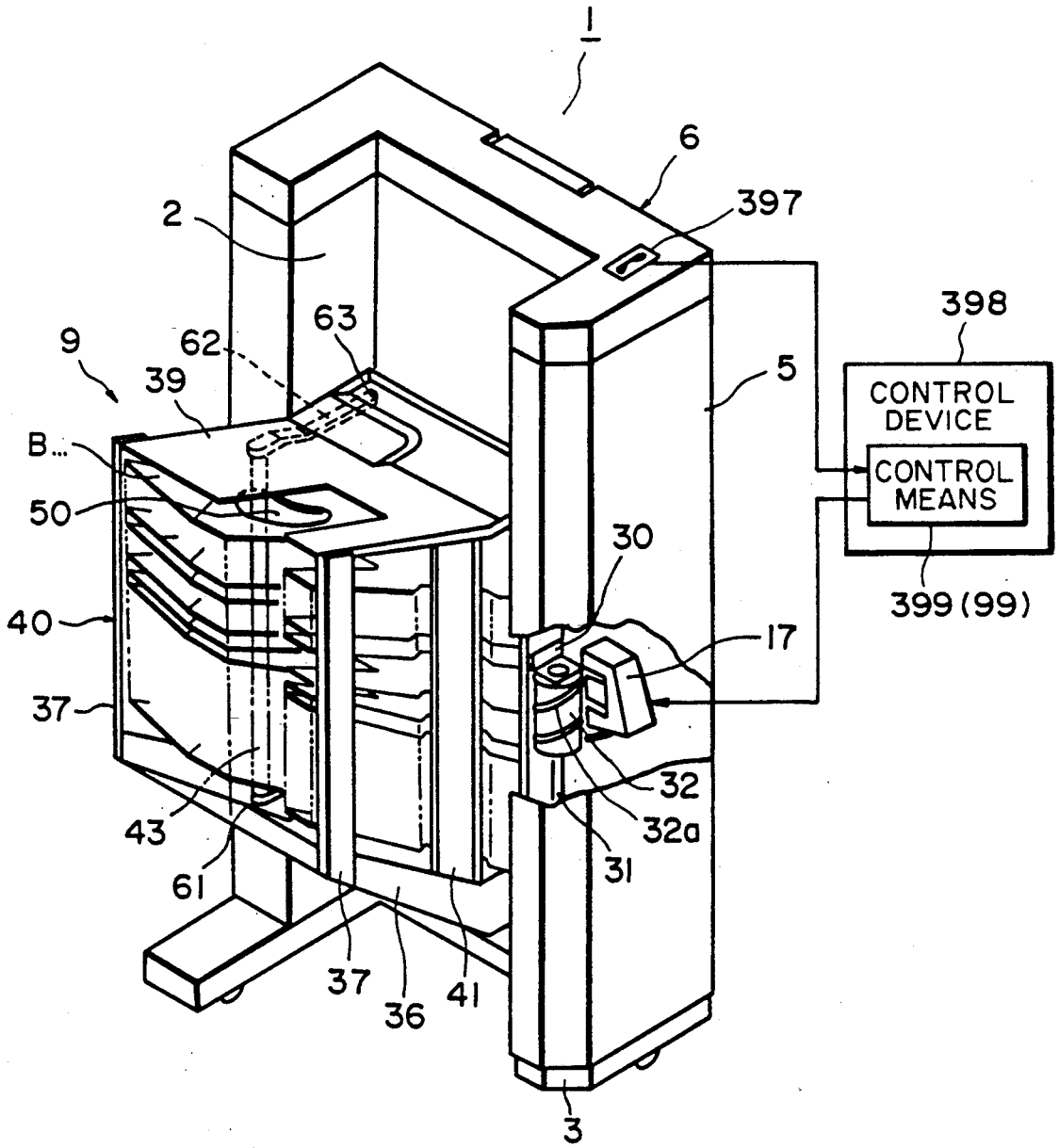
FIG. 26 is a perspective view of a sorter according to a further embodiment of the present invention.

Referring to FIG. 26, the sorter 1 is provided with a manual stapling button 397 on a top cover 5. The manual stapling button 397 is actuated when the sheet stapling operation by the stapler 17 is started or stopped.

A control device 398 for controlling this sorter 1 has a programmed control means 399 for starting and stopping the sheet stapling operation at any time. When the manual stapling button 397 is depressed either to start or stop the sheet stapling operation, the control means 399 controls so that the stapling operation starts or stops upon actuation of the manual stapling button 397. Therefore, the sets of sheets P received by the bins B are stapled or not stapled, as desired.

Figure 27:
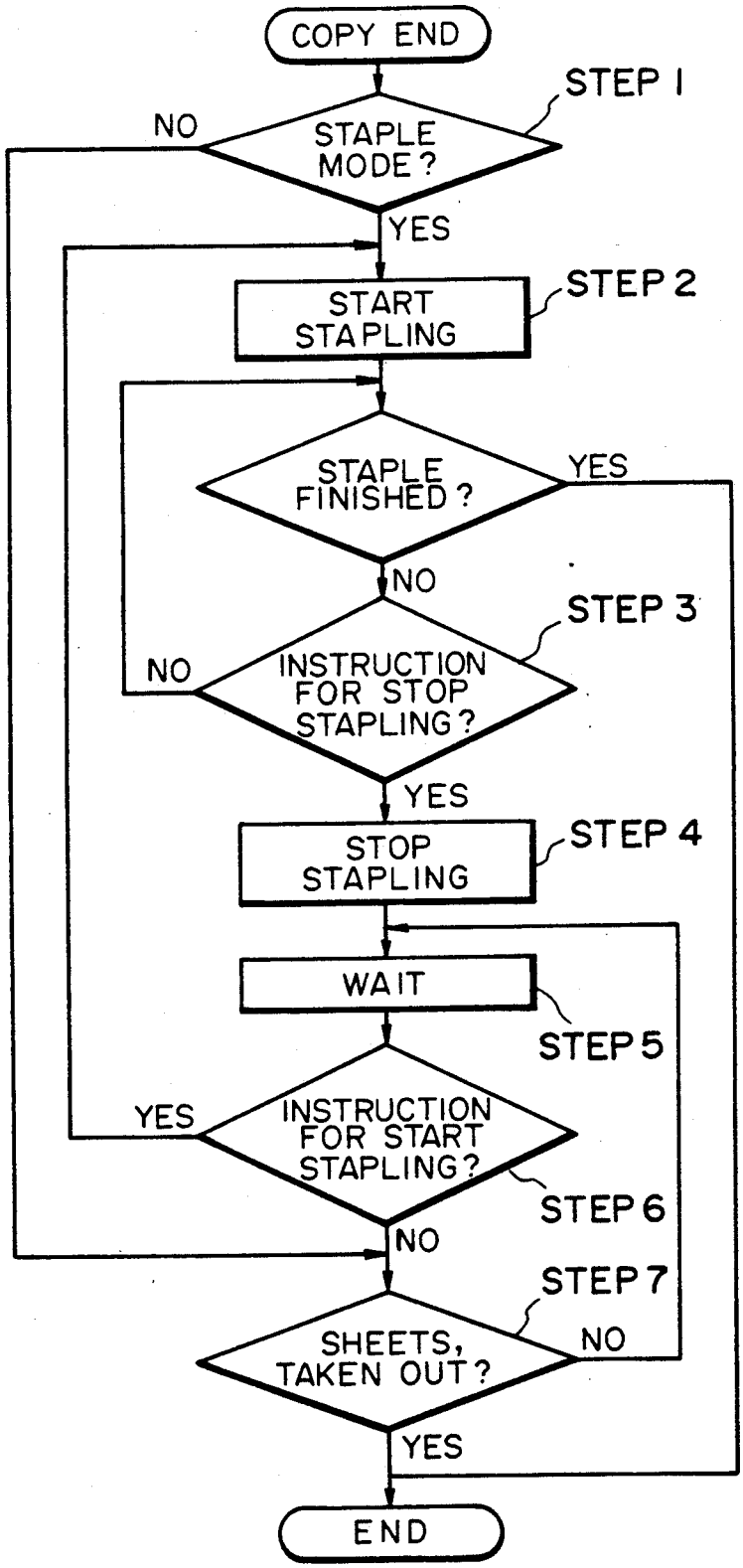
FIG. 27 is a flow chart illustrating an operation of the apparatus.

Referring to FIG. 27, the operation of the apparatus in this embodiment will be described. When the sorting mode is selected, the sheets P discharged from the image forming apparatus such as a copying machine are sequentially dispensed into the plural bins B. The sheets P dispensed in the bin B slide on the inclined bin B to abut to the base end portion B1. In addition, each time the sheet P is received by the bin B, the lateral end thereof is urged by the aligning rod 43 moved from its stand-by position 43*c* to the lateral aligning position 43*b*, so that the sheets are accommodated and aligned in each of the bins.

When an automatic stapling mode is selected (step 1) upon completion of the accommodating of the sheets P in the bin B, the sets of the sheets P are sequentially stapled (step 2). During the sequential stapling operation, when the operator depresses the manual stapling button 397, or when a stop key of the image forming apparatus is depressed (instruction of the stop) (step 3), the stapling operation is stopped (step 4). The stapler 17 is waits for the stapling operation for the next set of sheets (step 5). When the manual stapling button 397 is depressed to instruct the start of the stapling operation (step 6), the sheet stapling operation is started (step 2).

During the waiting period (step 5), if the sheets P are taken out of the bin B, and this event is detected (step 7), the operation with terminated.

Even if the automatic stapling mode is not selected, the stapler 17 is waits for (step 5) if the sheet P is not taken out of the bin B (step 7). Then, upon actuation of the manual stapling button 397 (step 6), the sheet stapling operation is started (step 2), and the above described sequential operations are performed.

In this embodiment, the stapling operations are continuously performed when the manual stapling button 397 is depressed. However, it is possible that one stapling operation is effected in response to one actuation of the manual stapling button 397.

As described in the foregoing, according to this embodiment of the present invention, there is provided an apparatus comprising manual means for starting and stopping a sheet stapling operation for the sets of sheets accommodated in the bins, and control means for starting and stopping the sheet stapling operation in response to the operation of the manual means. Thus, a desired number of sets of sheets can be stapled among the discharged sets. In addition, even if the stapling operation is stopped erroneously by the operator, the stapling operation can be started. Therefore, the operativity of the apparatus is increased.

In the foregoing, the respective embodiments have been described, but then may be combined as desired by one skilled in the art when the present invention is used.

While the invention has been described with reference to the structures disclosed herein, it is not confined to the details set forth and this application is intended to cover such modifications or changes as may come within the purposes of the improvements or the scope of the following claims.

What is claimed is:

1. A sheet binding apparatus, comprising:
- a sheet accommodating means for accommodating discharged sheets;
- binding means for binding the sheets accommodated in said sheet accommodating means;
- reference means for confining edges of the sheets accommodated in said sheet accommodating means to align the sheets;
- aligning means reciprocable between an aligning position for urging the sheets accommodated in said accommodating means to said reference means and a non-aligning position for permitting reception of a sheets; and
- control means for moving said aligning means from said non-aligning position to said aligning position and back to said non-aligning position, each time a sheet is received by said accommodating means, and for retaining after a last sheet to be bound by said binding means is received by said accommodating means, said aligning means at the aligning position until the sheets are bound by said binding means.

2. An apparatus according to claim 1, wherein said sheet accommodating means includes plural bins arranged in substantially vertically, and said aligning means includes a rod extend substantially vertically.

3. An apparatus according to claim 2, wherein said reference means includes a plate having a substantially vertical surface at a side of each of the bins.

4. An apparatus according to claim 3, wherein said aligning means is swingable toward and away from said reference means.

5. An apparatus according to claim 4, wherein said aligning means is movable in a movable range which is changed in accordance with sizes of the sheets accommodated in said sheet accommodating means.

6. An apparatus according to claim 2, further comprising control means for controlling said aligning means to urge, after the bins receive one sheet, respectively, the sheets all at once.

7. A sheet binding apparatus, comprising:
- a sheet accommodating means for accommodating discharged sheets;
- binding means for binding the sheets accommodated in said sheet accommodating means;
- binding operation instruction means for instructing binding operation of said binding means;
- reference means for confining edges of the sheets accommodated in said sheet accommodating means to align the sheets;
- aligning means reciprocable between an aligning position for urging the sheets accommodated in said accommodating means to said reference means and a non-aligning position for permitting reception of a sheet; and
- control means for moving said aligning means from said non-aligning position to said aligning position and back to said non-aligning position, each time a sheet is received by said accommodating means, wherein when said binding operation instruction means instructs the binding operation, said control means retains, after a last sheet to be bound by said binding means is received by said accommodating means, said aligning means at the aligning position until the sheets are bound by said binding means, and returns said aligning means to the non-aligning position.

8. An apparatus according to claim 7, wherein the non-aligning position is a stand-by position between a home position and the aligning position.

9. An apparatus according to claim 7, wherein said sheet accommodating means includes plural bins arranged in substantially vertically, and said aligning means includes a rod extend substantially vertically.

10. An apparatus according to claim 9, wherein during the binding operation, the bins are shifted one by one while said aligning means is at the aligning position.

11. An apparatus according to claim 9, wherein said reference means includes a plate having a substantially vertical surface at a side of each of the bins.

12. An apparatus according to claim 11, further comprising control means for controlling said aligning means to urge, after the bins receive one sheet, respectively, the sheets all at once.

13. An image forming apparatus, comprising in combination:
- a sheet accommodating means for accommodating discharged sheets;
- binding means for binding the sheets accommodated in said sheet accommodating means;
- reference means for confining edges of the sheets accommodated in said sheet accommodating means to align the sheets;
- aligning means reciprocable between an aligning position for urging the sheets accommodated in said accommodating means to said reference means and a non-aligning position for permitting reception of a sheet; and
- control means for moving said aligning means from said non-aligning position to said aligning position and back to said non-aligning position, each time a sheet is received by said accommodating means, and for retaining, after a last sheet to be bound by said binding means is received by said accommodating means, said aligning means at the aligning position until the sheets are bound by said binding means, whereby the sheets on which images are formed in response to image formation signal are accommodated in said sheet accommodating means and are bound by said binding means.

14. An image forming apparatus comprising in combination:

a sheet accommodating means for accommodating discharged sheets;

binding means for binding the sheets accommodated in said sheet accommodating means;

binding operation instruction means for instructing binding operation of said binding means;

reference means for confining edges of the sheets accommodated in said sheet accommodating means to align the sheets;

aligning means reciprocable between an aligning position for urging the sheets accommodated in said accommodating means to said reference means and a non-aligning position for permitting reception of a sheet; and control means for moving said aligning means from said non-aligning position to said aligning position and back to said non-aligning position, each time a sheet is received by said accommodating means, wherein when said binding operation instruction means instructs the binding operation, said control means retains, after a last sheet to be bound by said binding means is received by said accommodating means, said aligning means at the aligned position until the sheets are bound by said binding means, and returns said aligning means to the non-aligning position, whereby the sheets on which images are formed in response to image formation signal are accommodated in said sheet accommodating means and are bound by said binding means.

* * * * *

UNITED STATES PATENT AND TRADEMARK OFFICE

CERTIFICATE OF CORRECTION

PATENT NO. : 5,092,509

DATED : March 3, 1992

INVENTOR(S) : NAITO, et al.

It is certified that error appears in the above-identified patent and that said Letters Patent is hereby corrected as shown below:

FIGURE 21

"MOUEMENTS = n)" should read --MOVEMENTS = n)--.

ON THE TITLE PAGE

ITEM [57], ABSTRACT:

Line 2, "contain" should read --container--.
Line 4, "contain," should read --container,--.
Line 6, "contain" should read --container--.
Line 8, "contain" should read --container--.

COLUMN 7

Line 52, "upper" should read --upper,--.

COLUMN 10

Line 46, "stapler 17′" should read --stapler 17,--.
Line 51, "7b." should read --17b.--.

COLUMN 12

Line 65, "is" should be deleted.

UNITED STATES PATENT AND TRADEMARK OFFICE

CERTIFICATE OF CORRECTION

PATENT NO. : 5,092,509

DATED : March 3, 1992

INVENTOR(S) : NAITO, et al.

It is certified that error appears in the above-identified patent and that said Letters Patent is hereby corrected as shown below:

COLUMN 13

Line 3, "with" should read --will be--.
Line 5, "is" (first occurrence) should be deleted.

COLUMN 16

Line 14, "aligned" should read --aligning--.

Signed and Sealed this

Twentieth Day of July, 1993

*Attest:*

Michael K. Kirk

MICHAEL K. KIRK

*Attesting Officer*

*Acting Commissioner of Patents and Trademarks*